US010272446B2

(12) United States Patent
Piramoon

(10) Patent No.: US 10,272,446 B2
(45) Date of Patent: Apr. 30, 2019

(54) FIXED ANGLE CENTRIFUGE ROTOR HAVING TORQUE TRANSFER MEMBERS AND ANNULAR CONTAINMENT GROOVE

(71) Applicant: Fiberlite Centrifuge, LLC, Santa Clara, CA (US)

(72) Inventor: Sina Piramoon, San Jose, CA (US)

(73) Assignee: Fiberlite Centrifuge, LLC, Santa Clara, CA (US)

( * ) Notice: Subject to any disclaimer, the term of this patent is extended or adjusted under 35 U.S.C. 154(b) by 0 days.

(21) Appl. No.: 16/112,986

(22) Filed: Aug. 27, 2018

(65) Prior Publication Data

US 2018/0361401 A1 Dec. 20, 2018

Related U.S. Application Data

(62) Division of application No. 14/589,532, filed on Jan. 5, 2015, now Pat. No. 10,086,383.

(51) Int. Cl.

| | |
|---|---|
| ***B04B 5/04*** | (2006.01) |
| ***B04B 7/06*** | (2006.01) |
| ***B04B 7/08*** | (2006.01) |
| *B04B 7/02* | (2006.01) |

(52) U.S. Cl.

CPC ..... *B04B 7/06* (2013.01); *B04B 5/0414* (2013.01); *B04B 7/085* (2013.01); *B04B 2007/025* (2013.01)

(58) Field of Classification Search

CPC ..... B04B 7/06; B04B 5/0414; B04B 7/085; B04B 2007/025

USPC ..... 494/16

See application file for complete search history.

(56) References Cited

U.S. PATENT DOCUMENTS 3,819,111 A * 6/1974 Romanauskas ..... B04B 5/0414 494/16
3,901,434 A * 8/1975 Wright ..... B04B 5/0414 137/860
4,202,487 A * 5/1980 Edwards ..... B04B 5/0414 494/1

(Continued)

FOREIGN PATENT DOCUMENTS

WO 9308675 A1 4/1993
WO 9309874 A1 5/1993

OTHER PUBLICATIONS

Thermo Fisher Scientific; Thermo Scientific Fiberlite Carbon Fiber Rotors, product brochure, copyright 2013; 16 pages.

(Continued)

*Primary Examiner* — Charles Cooley

(74) *Attorney, Agent, or Firm* — Wood Herron & Evans LLP

(57) ABSTRACT

A fixed angle centrifuge rotor includes a rotor body having a circumferential sidewall and a plurality of circumferentially spaced tubular cavities. Each tubular cavity has an open end and a closed end, and is configured to receive a sample container therein. The rotor further includes a pressure plate operatively coupled to the rotor body so that the pressure plate, in combination with the plurality of tubular cavities and the circumferential sidewall of the rotor body, define a hollow chamber within the rotor. The rotor further includes a plurality of elongated torque transfer members supported by the rotor body and an annular containment groove.

8 Claims, 16 Drawing Sheets

(56) References Cited

U.S. PATENT DOCUMENTS 4,372,483 A * 2/1983 Wright ..... B04B 5/0414 494/16
4,991,462 A 2/1991 Breslich, Jr. et al.
5,071,402 A * 12/1991 Weyant, Jr. ..... B04B 5/0414 494/16
5,279,538 A 1/1994 Carson
5,411,465 A 5/1995 Glen et al.
5,484,381 A * 1/1996 Potter ..... B04B 5/0414 494/12
5,512,030 A * 4/1996 Barkus ..... B04B 7/02 494/16
5,558,616 A * 9/1996 Barkus ..... B04B 5/0414 494/12
5,601,522 A 2/1997 Piramoon
5,643,168 A 7/1997 Piramoon et al.
5,833,908 A 11/1998 Piramoon et al.
5,855,545 A * 1/1999 Kishi ..... B04B 7/02 494/12
5,876,322 A 3/1999 Piramoon
5,897,482 A * 4/1999 Lowe ..... B04B 5/0414 411/424
6,056,910 A 5/2000 Fritsch et al.
6,149,570 A * 11/2000 Lowe ..... B04B 5/0414 494/12
6,296,798 B1 10/2001 Piramoon
8,147,392 B2 4/2012 Piramoon et al.
8,273,202 B2 9/2012 Piramoon et al.
8,323,169 B2 12/2012 Piramoon
2010/0216622 A1 8/2010 Piramoon et al.
2011/0111942 A1* 5/2011 Piramoon ..... B04B 5/0414 494/16
2016/0193614 A1* 7/2016 Piramoon ..... B04B 7/06 494/60
2018/0353974 A1* 12/2018 Sato ..... B04B 7/06
2018/0361401 A1* 12/2018 Piramoon ..... B04B 5/0414

OTHER PUBLICATIONS

European Patent Office, International Patent Application No. PCT/US2016/012042, Invitation to Pay Additional Fees and, Where Applicable, Protest Fees (partial search report), dated Apr. 22, 2016, 7 pages.

European Patent Office, International Search Report and Written Opinion of the International Searching Authority, International Application No. PCT/US2016/012042, dated Jun. 27, 2016 (18 pages).

The International Bureau of WIPO, International Preliminary Report on Patentability and Written Opinion of the International Searching Authority, International Application No. PCT/US2016/012042, dated Jul. 20, 2017 (12 pages).

* cited by examiner

FIXED ANGLE CENTRIFUGE ROTOR HAVING TORQUE TRANSFER MEMBERS AND ANNULAR CONTAINMENT GROOVE

CROSS REFERENCE TO RELATED APPLICATIONS

The present application is a Divisional of co-pending U.S. Ser. No. 14/589,532, filed Jan. 5, 2015, the disclosure of which is hereby incorporated herein by reference in its entirety.

TECHNICAL FIELD

The present invention relates generally to centrifuge rotors and, more particularly, to a fixed-angle rotor configured to support samples within a centrifuge.

BACKGROUND

Centrifuge rotors are typically used in laboratory centrifuges to hold samples during centrifugation. While centrifuge rotors may vary significantly in construction and in size, one common rotor structure is the fixed angle rotor having a solid rotor body with a plurality of cell hole cavities distributed circumferentially within the rotor body and arranged symmetrically about an axis of rotation. Samples are placed in the cavities, allowing a plurality of samples to be subjected to centrifugation.

Conventional fixed angle centrifuge rotors may be made from metal or various other materials. However, a known improvement is to construct a centrifuge rotor by a compression molding and filament winding process wherein the rotor is fabricated from a suitable material such as composite carbon fiber. For example, a fixed angle centrifuge rotor may be compression molded from layers of resin-coated carbon fiber laminate material. Examples of fixed angle composite centrifuge rotors are described in U.S. Pat. Nos. 5,833,908, 6,056,910, 6,296,798, 8,147,392, and 8,273,202, each disclosure of which is expressly incorporated herein by reference in its entirety.

Because centrifuge rotors are commonly used in applications where the rotational speed of the centrifuges may exceed hundreds or even thousands of rotations per minute, it is important that centrifuge rotors are formed with structure designed to withstand the stresses and strains experienced during the high speed rotation of the loaded rotor. An improvement for providing structural rigidity to the rotor body during centrifugation is described in U.S. Pat. No. 8,323,169 (also owned by the common assignee), the disclosure of which is expressly incorporated herein by reference in its entirety. In that improvement, a pressure plate is coupled to a bottom portion of the rotor body, such that the pressure plate supports the tubular cavities during rotation, thereby minimizing the likelihood of rotor failure.

While a primary source of stresses and strains experienced by a rotor during centrifugation includes outwardly directed centrifugal forces exerted by loaded cavities, an additional source is torque exerted by the rotating centrifuge spindle. More specifically, a central portion of the rotor where a rotor hub couples to the centrifuge spindle generates high degrees of torque during rotation of the rotor, particularly during rotational acceleration and deceleration. This torque results in high degrees of concentrated stress on various components of the rotor. Whereas performance capabilities of conventional rotors may be limited by their ability to accommodate such torque and resulting stress in addition to that caused by centrifugal forces, a need exists for centrifuge rotors having improved structural rigidity for mitigating the stresses and strains caused by various sources, including torque, during centrifugation.

SUMMARY

The present invention overcomes the foregoing and other shortcomings and drawbacks of centrifuge rotors heretofore known for use for centrifugation. While the invention will be discussed in connection with certain embodiments, it will be understood that the invention is not limited to these embodiments. On the contrary, the invention includes all alternatives, modifications, and equivalents as may be included within the spirit and scope of the invention.

In one embodiment, a fixed angle centrifuge rotor includes a rotor body having a circumferential sidewall and a plurality of circumferentially spaced tubular cavities. Each tubular cavity has an open end and a closed end, and is configured to receive a sample container therein. The rotor further includes a pressure plate operatively coupled to the rotor body so that the pressure plate, in combination with the plurality of tubular cavities and the circumferential sidewall of the rotor body, define a hollow chamber within the rotor. The rotor further includes a plurality of elongated torque transfer members supported by the rotor body. Each of the plurality of torque transfer members has a first end located between a respective pair of adjacent tubular cavities, and extends radially inward in a direction toward a rotational axis of the rotor.

In another embodiment, a fixed angle centrifuge rotor includes a rotor body having a circumferential sidewall and a plurality of circumferentially spaced tubular cavities. Each tubular cavity has an open end and a closed end, and is configured to receive a sample container therein. The rotor further includes a plurality of pockets, each being located between a respective pair of adjacent tubular cavities. The rotor further includes a pressure plate operatively coupled to the rotor body so that the pressure plate, in combination with the plurality of tubular cavities and the circumferential sidewall of the rotor body, define a hollow chamber within the rotor. A plurality of circumferentially spaced upstanding tabs is supported by the pressure plate. Each of the plurality of tabs is received in a respective one of the plurality of pockets.

In another embodiment, a method is provided for manufacturing a centrifuge rotor. The method includes forming a rotor body having a circumferential sidewall and a plurality of circumferentially spaced tubular cavities. Each tubular cavity has an open end and a closed end, and is configured to receive a sample container therein. The method further includes operatively coupling a pressure plate having a plurality of circumferentially spaced upstanding tabs to the rotor body such that each tab is received in a respective pocket between a respective pair of adjacent tubular cavities.

In another embodiment, a method for manufacturing a centrifuge rotor includes forming a rotor body having a circumferential sidewall and a plurality of circumferentially spaced tubular cavities. Each of the tubular cavities has an open end and a closed end, and is configured to receive a sample container therein. The method further includes forming a plurality of elongated torque transfer members on the rotor body such that each of the torque transfer members has a first end located between a respective pair of adjacent tubular cavities and extends radially inward in a direction toward a rotational axis of the rotor.

In yet another embodiment, a fixed angle centrifuge rotor includes a plurality of tubular cavities spaced circumferentially about a rotational axis of the rotor. Each tubular cavity has an open end and a closed end, and is configured to receive a sample container therein. The rotor further includes an annular containment groove disposed above and circumferentially surrounding the plurality of tubular cavities. The annular containment groove has an upper reentrant portion in which a profile of the groove curves radially inward toward the rotational axis and axially downward toward the plurality of tubular cavities. The annular containment groove, in combination with the upper reentrant portion, is configured to capture and retain stray material within the rotor during rotation of the rotor.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate certain embodiments of the invention and, together with a general description of the invention given above, and the detailed description given below, serve to explain the invention.

DETAILED DESCRIPTION

Figure 1:
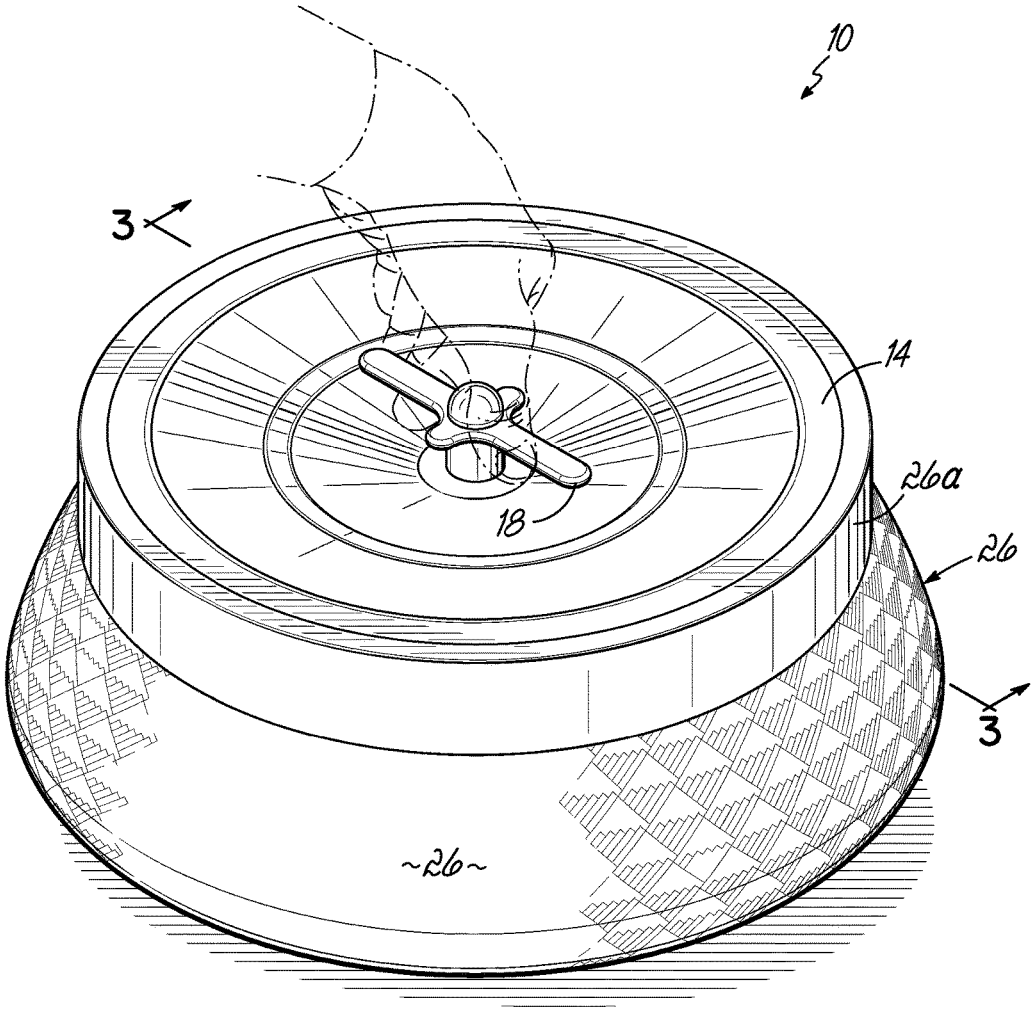
FIG. 1 is a perspective view of a centrifuge rotor in accordance with a first embodiment of the present invention, having a rotor lid and a rotor lid handle.
Figure 2:
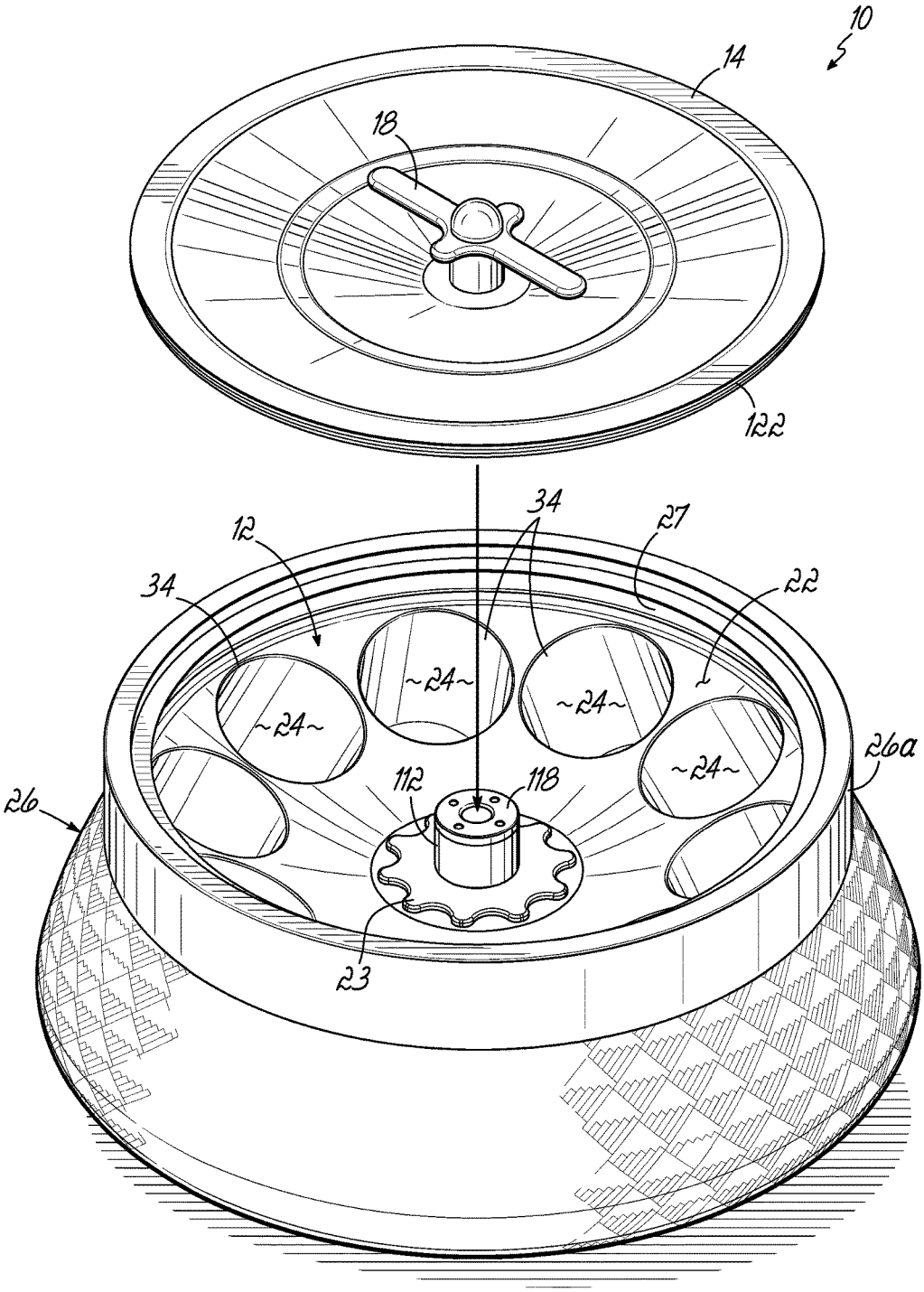
FIG. 2 is a partially disassembled, downward perspective view of the centrifuge rotor of FIG. 1.
Figure 3:
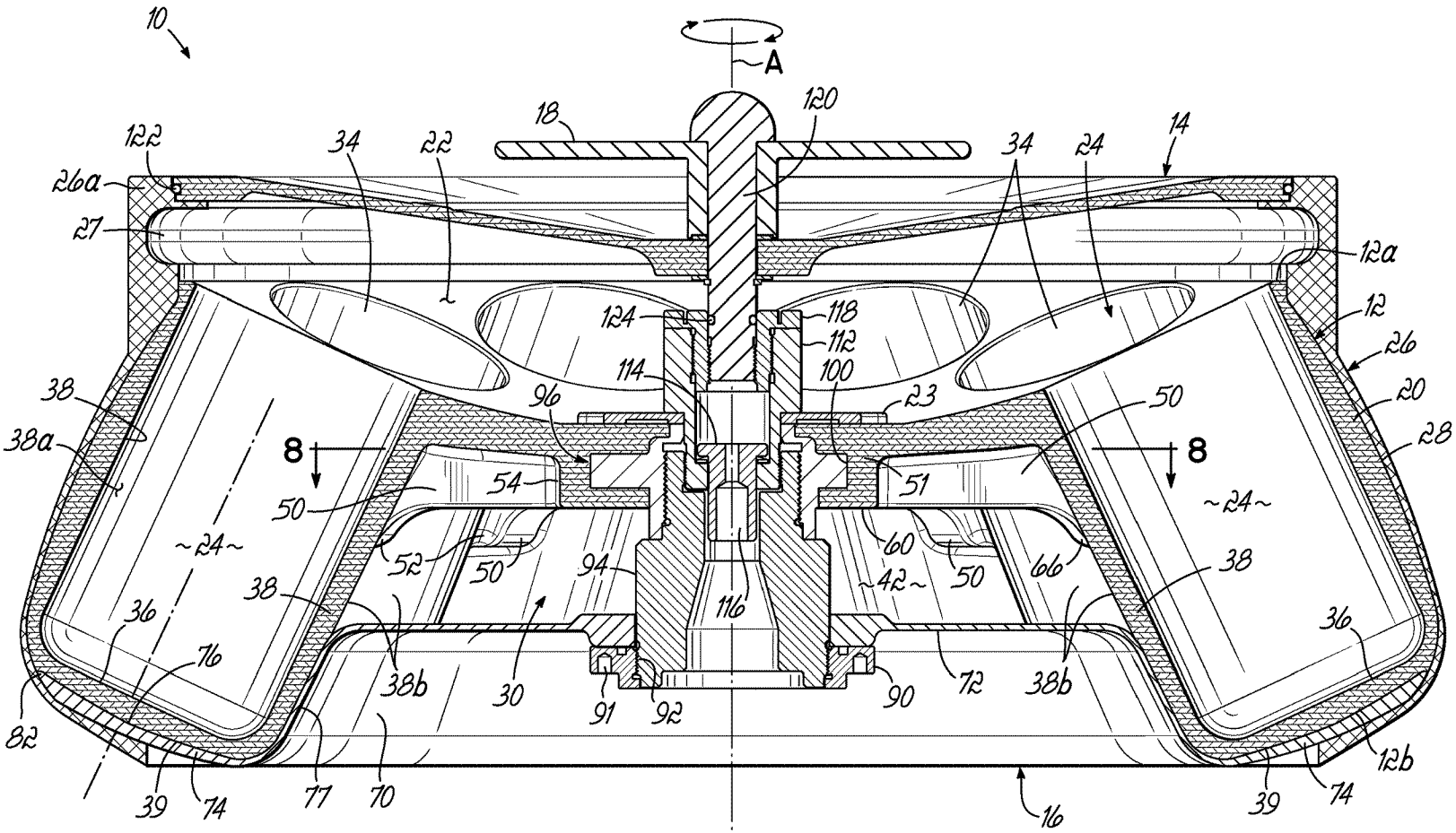
FIG. 3 is a cross-sectional view taken along line 3-3 of the centrifuge rotor of FIG. 1.
Figure 9:
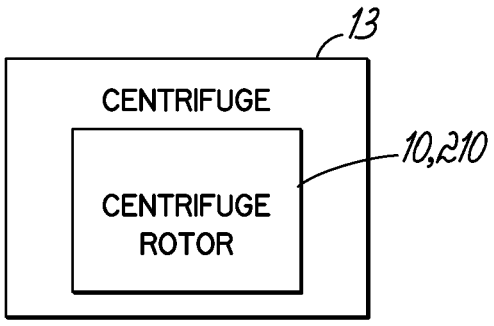
FIG. 9 is a diagrammatic view showing the centrifuge rotor of FIG. 1 installed in an exemplary centrifuge.

Referring now to the figures, and in particular to FIGS. 1-3, an exemplary centrifuge rotor 10 in accordance with one embodiment of the present invention is shown. The rotor 10 includes a rotor body 12, a rotor lid 14 operatively coupled to the rotor body 12 and supported above an upper end 12*a* thereof, and a pressure plate 16 operatively coupled to a lower end 12*b* of the rotor body 12. As used herein, the "upper end" of the rotor body 12 refers to the generally top-most end of the rotor body 12 along a central rotational axis A (FIG. 3) of the rotor 10, at which end the sample containers (not shown) are loaded and unloaded. Conversely, the "lower end" of the rotor body 12 refers to the generally bottom-most end of the rotor body 12 along the rotational axis A, at which end the rotor 10 is supported by a centrifuge 13 (FIG. 9). As described below, an elongated reinforcement 26 may be applied such that it extends continuously around the rotor body 12 and a portion of the pressure plate 16, thereby facilitating the coupling of the pressure plate 16 to the rotor body 12. The elongated reinforcement 26 may also extend above the upper end 12*a* of the rotor body 12, thereby forming an upper reinforcement portion 26*a* that is configured to receive and support an outer circumferential edge of the rotor lid 14.

Figure 1A:
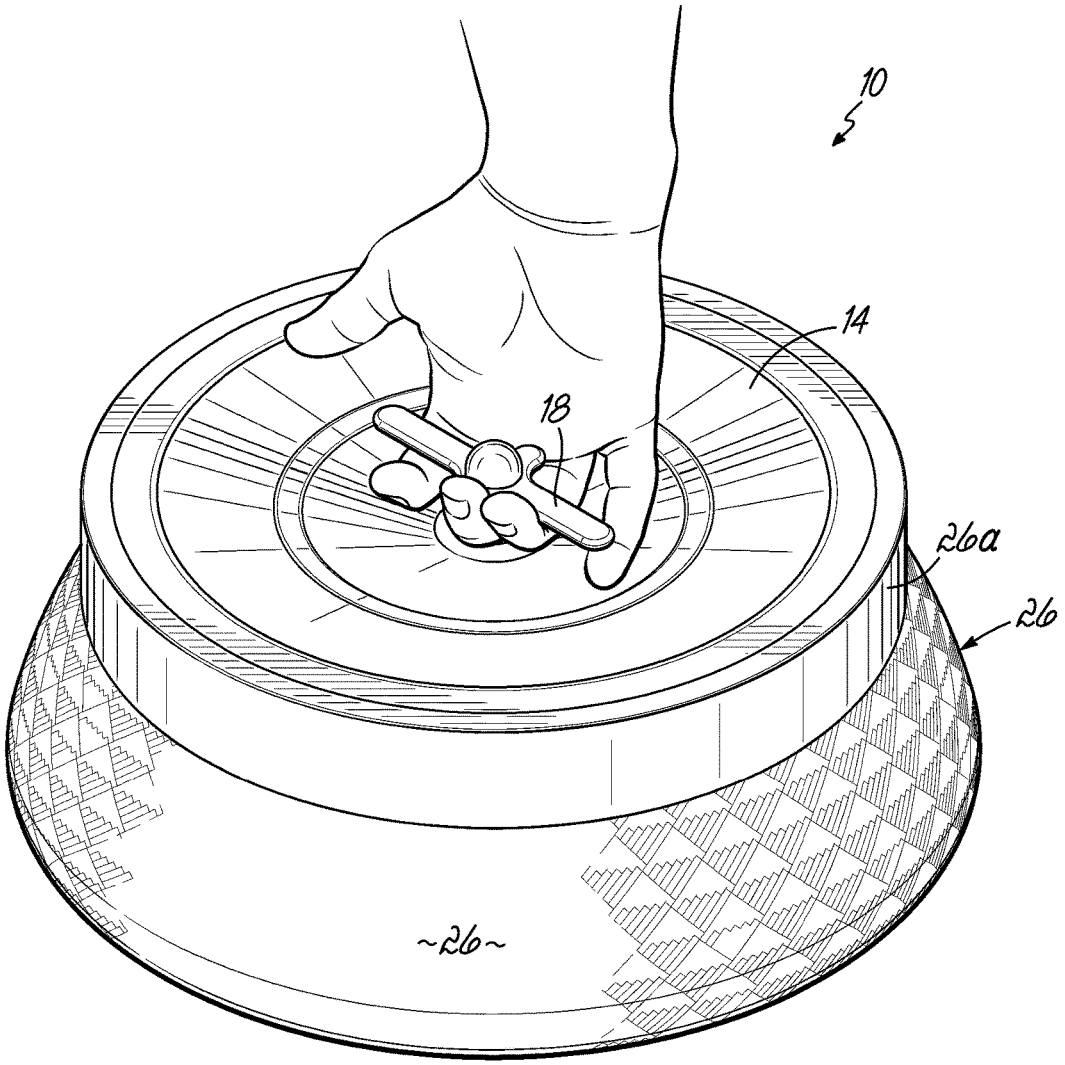
FIG. 1A is another perspective view of the centrifuge rotor of FIG. 1, showing lifting of the rotor.

As shown in FIGS. 1-2, the rotor lid 14 may include a handle 18 for assisting a user in attaching and removing the lid 14 relative to the upper end 12*a* of the rotor body 12. In particular, the handle 18 may be rotated (FIG. 1) for locking the lid 14 with, or unlocking the lid 14 from, the rotor body 12, and may be gripped for vertically moving the lid 14 (FIG. 1A) into engagement with or away from the rotor body 12 after loading or unloading sample containers (not shown). Additionally, the handle 18 may be gripped by the user for supporting the rotor 10 in a substantially vertical direction, for example when inserting the rotor 10 into, or removing the rotor 10 from, the centrifuge 13, or when transporting the rotor 10.

Figure 4:
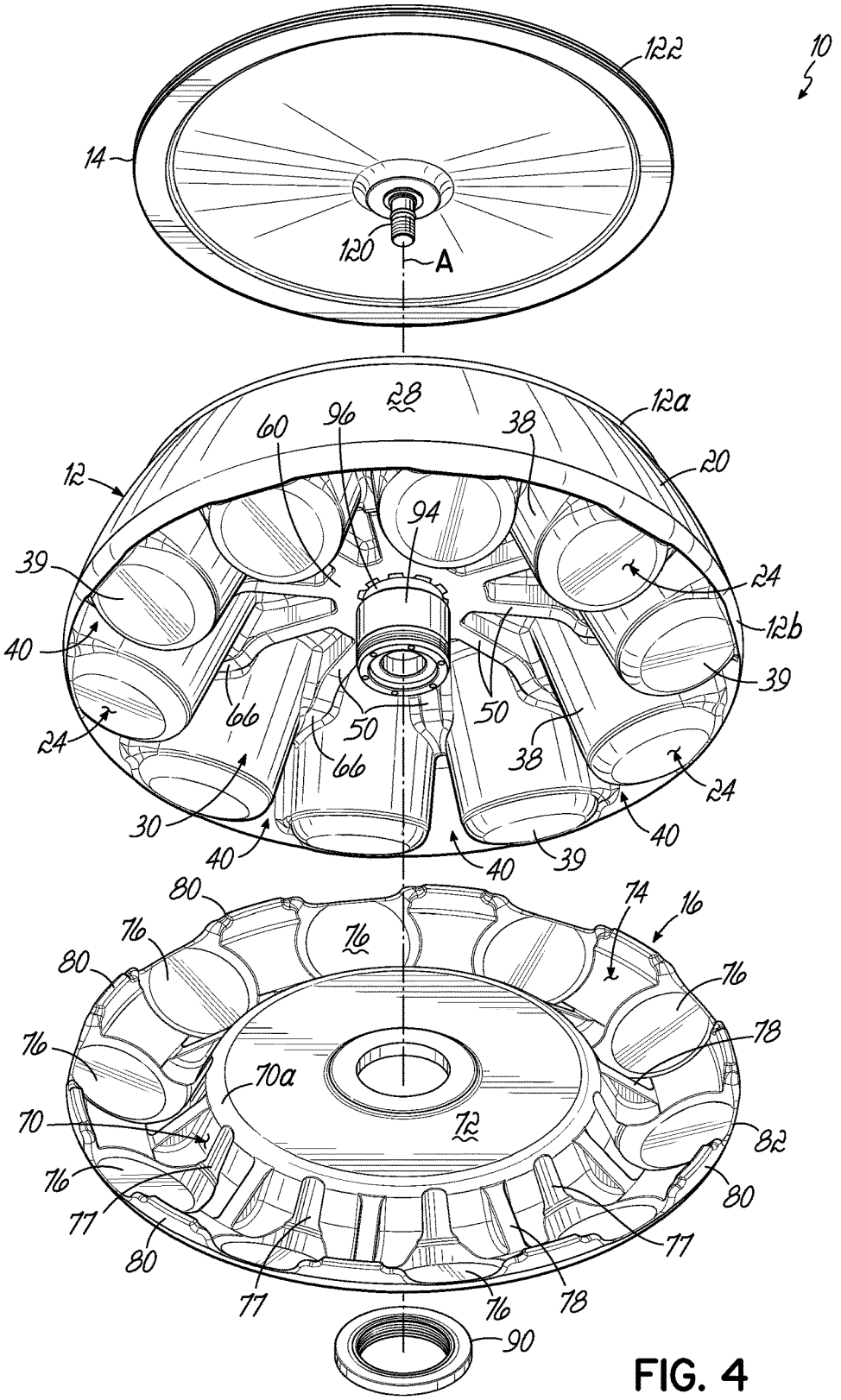
FIG. 4 is a partially disassembled, perspective view of the centrifuge rotor of FIG. 1, showing a rotor body and a pressure plate tilted open for better viewing and prior to application of an elongated reinforcement.

As shown in FIGS. 2-4, the rotor body 12 is formed symmetrically about a rotational axis A, about which sample containers are centrifugally rotated during operation. The rotor body 12 includes a circumferentially-extending sidewall 20 and a top wall 22 through which a plurality of circumferentially-spaced tubular cell hole cavities 24 extend for receiving a corresponding plurality of sample containers (not shown). The top wall 22 may include an identification element 23, shown in FIG. 3 in the form of a disk, for displaying indicia for identifying each individual tubular cavity 24.

The elongated reinforcement 26, which may be a helical winding, extends continuously around a generally smooth, exterior surface 28 of the circumferentially-extending sidewall 20. As used herein, the term "generally smooth" is intended to describe a surface 28 that does not have a stepped configuration, and is generally free of corners or sharp edges. In this regard, the above-defined term is not intended to define the surface roughness of the surface 28. The rotor body 12 may be formed such that the generally smooth exterior surface 28 requires no additional machining or finishing prior to the application of the reinforcement 26. In one embodiment, the rotor body 12 may be formed using the methods disclosed in U.S. Pat. Nos. 8,147,392 and 8,273,202, incorporated by reference above. The rotor body 12 may be formed of any suitable material or combination of materials, including carbon fiber, for example.

As best shown in FIGS. 2 and 3, the upper reinforcement portion 26*a* formed by the elongated reinforcement 26 may be shaped to define an annular liquid containment groove 27 spaced axially above the upper end 12*a* of the rotor body 12. During centrifugation of samples contained within the sample containers (not shown) held by the rotor 10, high centrifugal forces can result in leakage of sample through the sample container closures. The concave curvature of the liquid containment groove 27 may operate to capture at least a portion of the leaked sample such that it is retained within the rotor 10 and not ejected therefrom during rotation, thereby maintaining a safe and clean working environment.

The illustrated embodiment of the rotor 10 includes ten tubular cell hole cavities 24, which may be of any suitable cavity volume. For example, in one embodiment, each of the ten tubular cavities 24 may be sized to receive a sample container having an internal volume of approximately 1,000 ml. Persons skilled in the art will appreciate that a rotor in accordance with the principles of the invention may be formed with any suitable number of tubular cavities 24, wherein each cavity 24 defines any suitable cavity volume. For example, in one alternative embodiment, described in greater detail below in connection with FIGS. 10-17, a centrifuge rotor may be formed with six tubular cavities, each tubular cavity being sized to receive a sample container having an internal volume of approximately 2,000 ml. In yet another alternative embodiment (not shown), a centrifuge rotor may be formed with eight tubular cavities, each tubular cavity being sized to receive a sample container having an internal volume of approximately 1,500 ml. Persons skilled in the art will also appreciate that additional features of the rotor 10, as described herein, may be modified in quantity, size, and/or position as appropriate, while generally maintaining the same functionality of the rotor 10 for performing centrifugal operations on one or more samples (not shown) received in the rotor body 12, in order to account for a particular quantity and/or size of the tubular cavities 24.

Each of the tubular cell hole cavities 24 extends from the top wall 22 into an interior 30 of the rotor body 12, in a direction generally toward the lower end 12*b* of the rotor body 12 and angularly relative to the rotational axis A. As used herein, the term "interior" refers to the general portion of a centrifuge rotor that is enclosed by and disposed radially inward of the corresponding circumferential sidewall of the rotor body. Additionally, as used herein, the term "tubular" refers to cavities having any suitable cross-sectional shape, such as rounded shapes (e.g., oval, circular or conical), quadrilateral shapes, regular polygonal shapes, or irregular polygonal shapes, for example. Accordingly, this term is not intended to be limited to the generally circular cross-sectional profile of the exemplary tubular cavities illustrated in the figures.

Each tubular cavity 24 includes an open end 34 at the top wall 22 and an oppositely disposed closed end 36 oriented toward the lower end 12*b*. Each cavity 24 is defined by a sidewall 38 and a bottom wall 39, and is suitably sized and shaped to receive a sample container therein (not shown) for centrifugation about rotational axis A. Each cavity sidewall 38 includes an inner face 38*a* that receives and supports the respective sample container, and an outer face 38*b* that faces generally toward the interior 30 of the rotor body 12.

Figure 5:
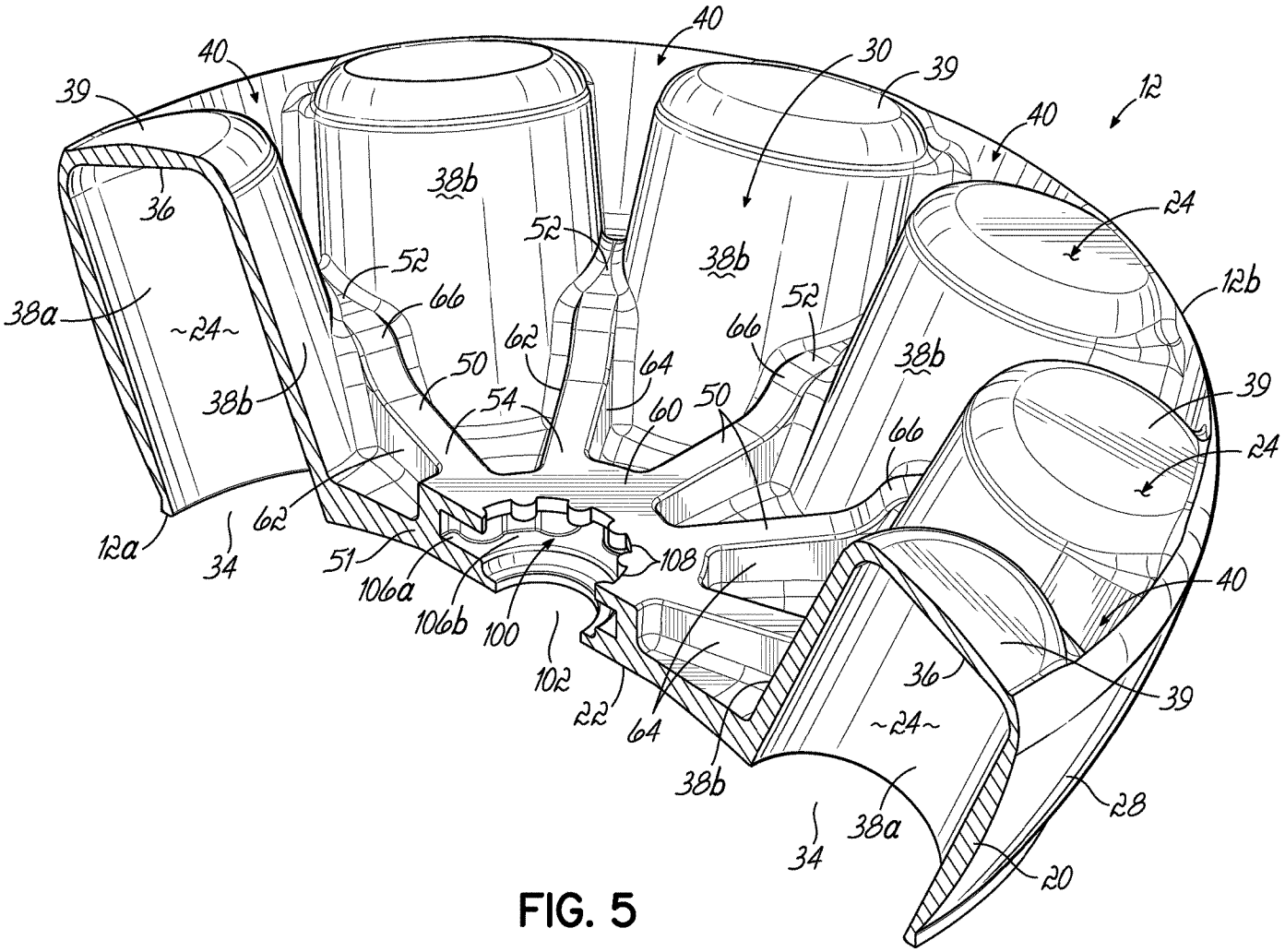
FIG. 5 is a cross-sectional view taken along line 3-3 of the rotor body of the centrifuge rotor of FIG. 1, showing the rotor body inverted and with a rotor hub and a rotor insert being hidden from view.

As best shown in FIGS. 4 and 5, the tubular cavities 24 are circumferentially spaced radially inward of the circumferential sidewall 20, such that the sidewall 20 and the outer faces 38*b* of the cavities 24 define a plurality of circumferentially-spaced pockets 40, each pocket 40 being defined between an adjacent pair of respective tubular cavities 24. As described in greater detail below, the outer faces 38*b*, in combination with the circumferential sidewall 20 and the pressure plate 16, collectively define a centrally located, hollow chamber 42 including the pockets 40.

Referring to FIGS. 3-5, a plurality of circumferentially-spaced, elongated torque transfer members 50 are supported by the rotor body 12, and may be operatively coupled to a central interior portion 51 of the rotor body 12, according to one embodiment. As described in greater detail below, the torque transfer members 50 operate to transfer torque from a centrifuge spindle (not shown) of the centrifuge 13 to the tubular cavities 24 during centrifugation. Each torque transfer member 50 extends radially between an outer first end 52 and an inner second end 54 oriented toward the rotational axis A. In the embodiment shown, the first end 52 of each torque transfer member 50 extends between and tangentially to an adjacent pair of respective tubular cavities 24, toward a respective pocket 40. Furthermore, the terms "first end" and "second end," as used herein in connection with a first end and a second end of a torque transfer member, are not intended to specify terminal, point locations of a torque transfer member. Rather, "first end" and "second end" are intended to refer to the general portions of a torque transfer member that are located radially adjacent to a respective pair of adjacent tubular cavities at one end, and adjacent to the central axis A at an opposite end, respectively.

As shown, the rotor 10 may include ten torque transfer members 50, such that one member 50 extends between each adjacent pair of tubular cavities 24. As described above, the rotor 10 may be formed with any suitable number of tubular cavities 24. Accordingly, the rotor 10 may be formed with any suitable number of torque transfer members 50, to maintain any desired ratio of torque transfer members 50 to tubular cavities 24. For example, as described below in connection with the alternative embodiment shown in FIGS. 10-17, a centrifuge rotor may include six tubular cavities and six torque transfer members. In yet another alternative embodiment (not shown), a centrifuge rotor may include eight tubular cavities and eight torque transfer members.

The rotor 10 may further include a torque transfer ring 60 supported by the rotor body 12, and which may be operatively coupled to the central interior portion 51 of the rotor body 12, according to one embodiment. As shown, the torque transfer ring 60 extends from a bottom surface of the top wall 22 into the interior 30, and thus into the hollow chamber 42. As shown, the torque transfer ring 60 is centrally located about the rotational axis A such that the second end 54 of each torque transfer member 50 extends radially toward and operatively couples to the torque transfer ring 60. In one embodiment, the torque transfer members 50 and torque transfer ring 60 may be formed integrally as one piece with the rotor body 12, including the top wall 22, the central interior portion 51, and the sidewalls 38 of the tubular cavities 24. In an alternative embodiment, either or both of the torque transfer members 50 and the torque transfer ring 60 may be releasably coupled to the rotor body 12.

Additionally, as shown in FIGS. 3-6 and 8, the torque transfer members 50 may be formed integrally as one piece with the torque transfer ring 60. In an alternative embodiment, the torque transfer members 50 may be releasably coupled to the torque transfer ring 60. In another alternative embodiment, the rotor 10 may be formed without the torque transfer ring 60, such that the torque transfer members 50 extend radially (independently) toward the rotational axis A. In yet another embodiment, the torque transfer members 50 may be coupled to one or more intermediate structures (not shown) positioned radially between the torque transfer members 50 and the torque transfer ring 60, when provided. Alternatively, when the torque transfer ring 60 is not provided, the torque transfer members 50 may be coupled, either individually or in sets of two or more, to one or more intermediate structures (not shown) positioned radially between the torque transfer members 50 and the rotational axis A.

Figure 6:
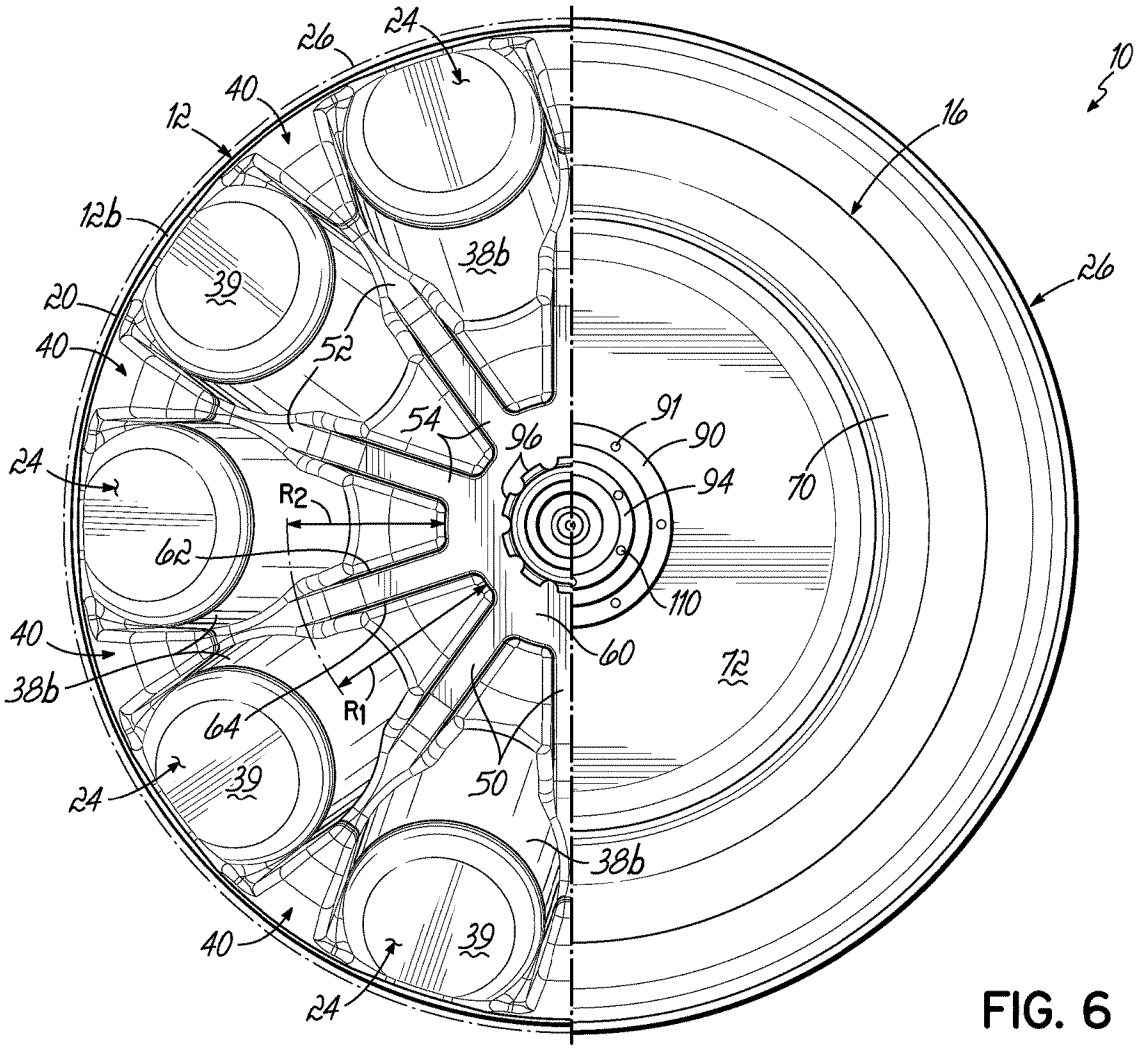
FIG. 6 is a partially broken away plan view of the bottom of the centrifuge rotor of FIG. 1.

As best shown in FIGS. 4-6, each torque transfer member 50 may be formed with a first sidewall 62 and an opposed second sidewall 64, the second sidewall 64 being arranged clockwise from the first sidewall 62 when viewing the rotor body 12 from the lower end 12*b* in a direction toward the top wall 22 (FIGS. 5 and 6). Each sidewall 62, 64 has a radial length measured generally between the first end 52 and the second end 54 of the torque transfer member 50. As shown in the illustrated embodiment, the radial length of the first sidewall 62 may be greater than or less than the radial length of the second sidewall 64 of the same torque transfer member 50. For example, as shown in FIG. 6, an exemplary radial length R1 of a first sidewall 62 is greater than an exemplary radial length R2 of a second sidewall 64. Additionally, the torque transfer members 50 may be arranged circumferentially in an alternating manner such that (i) the radial length of each first sidewall 62 is equal to the radial length of the second sidewall 64 of each adjacent torque transfer member 50, and (ii) the radial length of each second sidewall 64 is equal to the radial length of the first sidewall 62 of each adjacent torque transfer member 50. In certain alternative embodiments, such as the one described below in connection with FIGS. 10-17, the torque transfer members may be formed symmetrically such that the first and second sidewalls of each torque transfer member is formed with radial lengths and curvatures that are equal.

The torque transfer members 50 extend generally axially from a bottom surface of the top wall 22 into the interior 30, and thus into the hollow chamber 42, such that the sidewalls 62, 64 define an axial thickness of a respective torque transfer member 50. As best shown in FIGS. 3 and 5, each of the torque transfer members 50 may be formed with an axial thickness that progressively increases in a radially outward direction from the second end 54 toward the first end 52, such that the first end 52 has a greater axial thickness than the second end 54. Additionally, as shown best in FIG. 5, the first end 52 of each torque transfer member 50 may include an axial step 66 generally near or at the location where the torque transfer member 50 extends between the respective pair of adjacent tubular cavities 24.

The torque transfer members 50 and torque transfer ring 60 may be formed of any suitable material or combination of materials. For example, the torque transfer members 50 and/or the torque transfer ring 60 may be formed of a carbon fiber composite having an optimized fiber orientation. In an alternative embodiment, the torque transfer members 50 and/or the torque transfer ring 60 may be formed of a metal.

Referring to FIGS. 3 and 4, the pressure plate 16 of the rotor 10 includes a central, generally conical upstanding wall portion 70 having a rounded upper portion 70*a*, a top wall portion 72 extending radially inward from the conical wall portion 70, and an annular bottom wall portion 74 extending generally radially outward from the conical wall portion 70.

The pressure plate 16 may be operatively coupled to the lower end 12*b* of the rotor body 12, such that the conical wall portion 70 is received within the interior 30 of the rotor body 12 and engages a radially inward-facing side portion of each of the outer faces 38*b* of the tubular cavities 24. The pressure plate 16 may be seated against the rotor body 12 such that the top wall portion 72 remains axially spaced from the top wall 22, the torque transfer members 50, and torque transfer ring 60 supported by the top wall 22. Thereby, the coupling of the pressure plate 16 to the rotor body 12 fully defines the hollow chamber 42, including the pockets 40. In particular, the hollow chamber 42 is bordered by the circumferential sidewall 20, the top wall 22, and the outer faces 38*b* of the rotor body 12, and by the conical wall portion 70, the top wall portion 72, and the bottom wall portion 74 of the pressure plate 16.

Accordingly, in the illustrated embodiment of rotor 10, a substantial portion of each of the outer faces 38*b* of the tubular cavities 24 is surrounded by hollow space including the hollow chamber 42 and a respective pair of adjacent pockets 40. As used herein, the term "substantial," when used to describe the portion of an outer face of a tubular cavity surrounded by hollow space, is intended to describe an embodiment where at least about 40%, and preferably between about 40% and about 60%, of a particular outer face of a tubular cavity is surrounded by hollow space.

The annular bottom wall portion 74 of the pressure plate 16 includes a plurality of circumferentially-spaced depressions 76, and the conical wall portion 70 includes a corresponding plurality of circumferentially-spaced scallops 77 that extend downwardly toward and open to the depressions 76. In particular, the pressure plate 16 preferably includes one depression 76 and one scallop 77 for each tubular cavity 24 (i.e., ten depressions 76 and ten scallops 77 for the embodiment shown in FIGS. 1-9).

With continued reference to FIGS. 3 and 4, the depressions 76 of pressure plate 16 are configured to receive and engage, in abutting relationship, the plurality of bottom walls 39 of the tubular cavities 24, when the pressure plate 16 is coupled to the rotor body 12. Similarly, the scallops 77 are configured to receive and engage, in abutting relationship, the outer faces 38*b* of the tubular cavities 24. In that regard, the depressions 76 are suitably sized and shaped such that each depression 76 contacts a substantial portion of a respective bottom wall 39 of a respective tubular cavity 24, and the scallops 77 are suitably sized and shaped such that each scallop 77 substantially conforms to the curvature of a lower portion of a respective outer face 38*b*. Accordingly, the pressure plate 16 may be mated with the rotor body 12 such that each depression 76 and corresponding scallop 77 jointly engage a respective tubular cavity 24. In this manner, the depressions 76 provide structural support to the tubular cavities 24, thereby providing rigidity during high-speed rotation of the rotor 10, while the scallops 77 assist in maintaining circumferential alignment of the pressure plate 16 relative to the rotor body 12. In an alternative embodiment, the pressure plate 16 may include a quantity of depressions that is less than the quantity of tubular cavities 24, where each depression is suitably sized and shaped to receive and engage two or more tubular cavities 24.

The pressure plate 16 may further include a plurality of circumferentially-spaced ribs 78 extending angularly between the conical upstanding wall portion 70 and the annular bottom wall portion 74. In the embodiment shown, a rib 78 is provided between each pair of adjacent depressions 76 and scallops 77. When the pressure plate 16 is coupled to the rotor body 12, each rib 78 extends between a respective pair of adjacent tubular cavities 24, and partially into the respective pocket 40. The ribs 78 operate in a brace-like manner to provide additional structural support to the pressure plate 16, and thus also to the rotor body 12, during high-speed rotation of the rotor 10.

Figure 7:
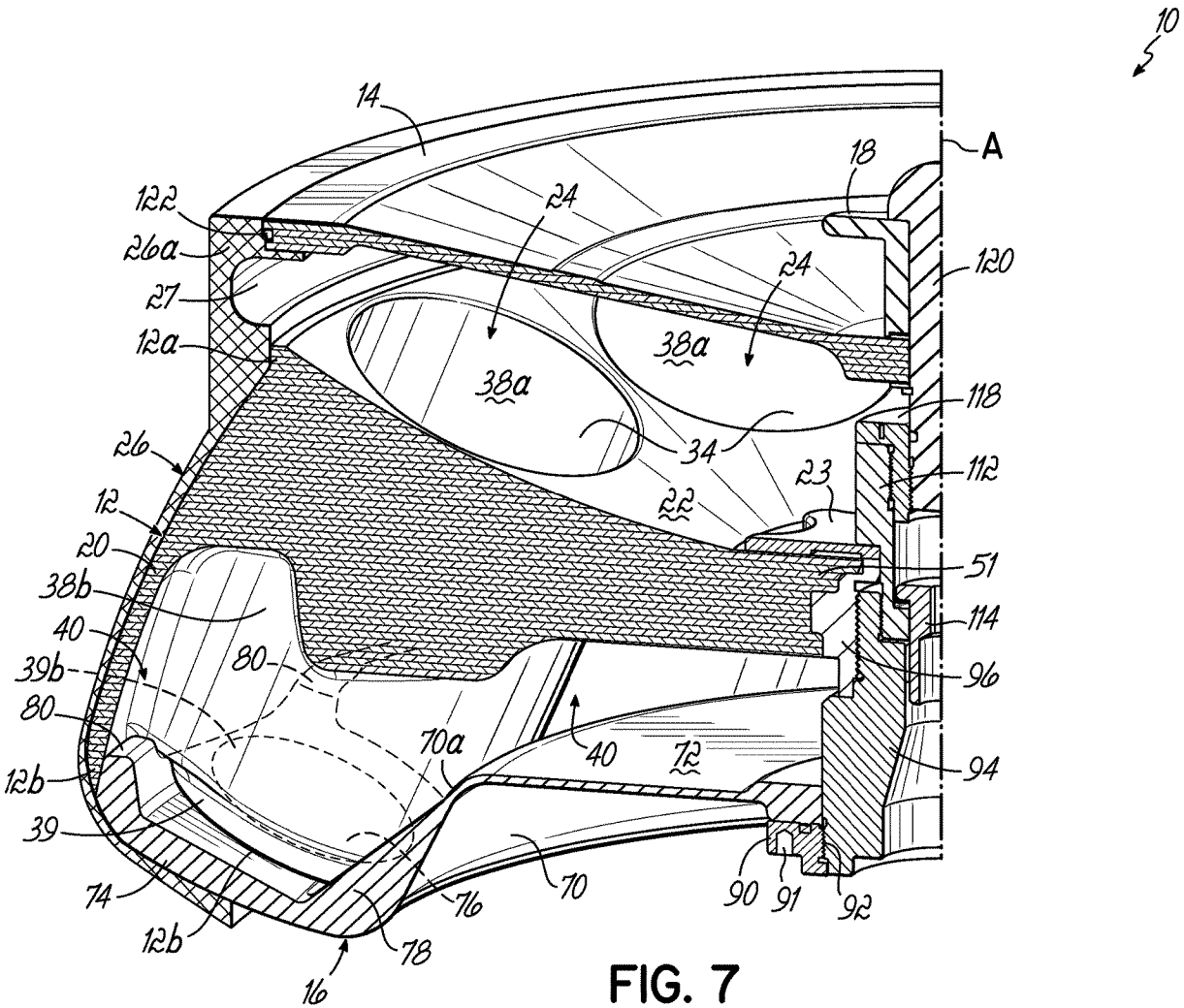
FIG. 7 is a perspective, partial cross-sectional view taken axially through a pocket of the rotor body of the centrifuge rotor of FIG. 1, showing additional detail of a tab of a pressure plate being received within the pocket of the rotor body.
Figure 8:
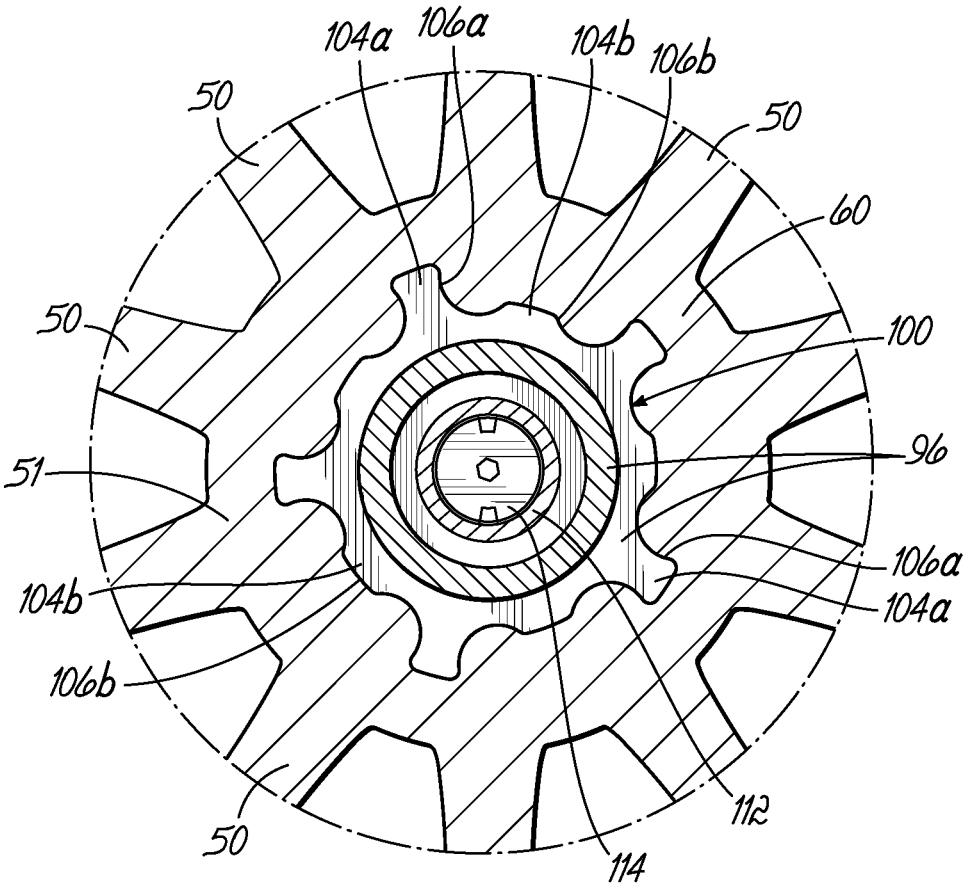
FIG. 8 is a partial cross-sectional view taken along line 8-8 of the centrifuge rotor of FIG. 3, showing additional detail of a rotor insert.

The pressure plate 16 may further include a plurality of circumferentially-spaced upstanding tabs 80 extending between the depressions 76, as best shown in FIG. 4. In the illustrated embodiment, the tabs 80 extend generally axially from the bottom wall portion 74 adjacent a circumferential outer edge 82 of the pressure plate 16. Each tab 80 is suitably sized and shaped to be received in a pocket 40 formed between a respective pair of adjacent tubular cavities 24 when the pressure plate 16 is coupled with the rotor body 12, as shown in FIG. 7. In that regard, the tab 80 engages corresponding structure defined by the sidewall 38 and the bottom wall 39 of the respective tubular cavity 24. Accordingly, the tabs 80 properly align the pressure plate 16 with the rotor body 12 during assembly, and provide additional structural support to the rotor body 12, including the tubular cavities 24, during high-speed rotation of the rotor 10.

Coupling of the pressure plate 16 to the rotor body 12 may be facilitated by a fastener, such as a retaining nut 90, for example. In the embodiment shown, the retaining nut 90 threadedly engages an externally threaded portion 92 of a rotor hub 94. As described in greater detail below, the rotor hub 94 facilitates engagement of the rotor 10 with a centrifuge spindle (not shown) of the centrifuge 13 to enable high-speed rotation of the rotor 10 during centrifugation. Engagement of the nut 90 is effected from an underside of pressure plate 16, with such engagement thereby operatively securing the rotor hub 94 to the top wall portion 72 of the pressure plate 16. The nut 90 may include two or more circumferentially-spaced tool-engagement recesses 91 (FIG. 6) for facilitating rotational attachment and removal of the nut 90. The rotor hub 94, in turn, is threadedly engaged with a rotor insert 96, described below, provided within the central interior portion 51 of the rotor body 12.

Coupling of the pressure plate 16 to the rotor body 12 may be further enhanced by compression-molding these two components together with the elongated reinforcement 26. In one embodiment, as disclosed in U.S. Pat. Nos. 8,147,392, 8,273,202, and 8,323,169, incorporated by reference above, the reinforcement 26 may be applied by helically winding a continuous strand of high strength fiber, such as a single tow or strand of carbon fiber (e.g., a resin-coated carbon fiber), around at least a portion of the exterior surface 28 of rotor body 12, and over exposed radially outer portions of the pressure plate 16. In particular, as disclosed in the above identified patents, the strand may be tightly wound repeatedly around the rotor body 12 and the pressure plate 16 such that the strand overlaps itself to define crossing points at regions that experience greatest stress during centrifugation, thereby forming a plurality of reinforcement layers 26. Persons of ordinary skill in the art will appreciate that various alternative methods of coupling the pressure plate 16 to the rotor body 12 may be used.

As described above, the rotor 10 of the illustrated embodiment includes a rotor insert 96 configured to receive and threadedly engage the rotor hub 94. As shown best in FIGS. 5 and 8, the rotor insert 96 is provided within an internal pocket 100 formed in the central interior portion 51 of the rotor body 12. The rotor insert 96 is located about the rotational axis A such that it extends through an opening 102 formed in the top wall 22, the central interior portion 51, and the torque transfer ring 60. The rotor insert 96 includes a plurality of alternating, radially extending long arms **104*a* and short arms 104*b* that are received within a corresponding plurality of alternating, radially extending long channels 106*a* and short channels 106*b* of the internal pocket 100. In one embodiment, the rotor 10 may be formed such that the number of arms 104*a*, 104*b* and the number of corresponding channels 106*a*, 106*b* is equal to the number of tubular cavities 24. More specifically, the number of long arms 104*a* may be equal to one-half of the number of tubular cavities 24. For example, in the embodiment shown, the rotor 10 includes ten tubular cavities 24 and a rotor insert 96 having five long arms 104*a* and five short arms 104*b*, and an internal pocket 100 having five long channels 106*a* and five short channels 106*b* for receiving the respective arms 104*a*, 104*b*. Persons skilled in the art will appreciate that alternative embodiments of the rotor 10 may be formed with any desired ratio of tubular cavities 24 to rotor insert arms 104, 104*b*, and corresponding pocket channels 106*a*, 106*b***. Additionally, in alternative embodiments, the rotor insert arms and corresponding pocket channels may be formed with any suitable shapes and sizes.

The rotor insert 96 may be formed of any suitable material, such as a metal, and may be molded into the rotor body 12 during body formation, as disclosed by U.S. Pat. Nos. 8,147,392 and 8,273,202, incorporated by reference above. Additionally, as shown in FIG. 5, the torque transfer ring 60 of the rotor body 12 may include keying slots 108 for mating with corresponding radial protrusions (not shown) provided an outer surface of a portion of the rotor insert 96.

The rotor body 12, the rotor lid 14, and the pressure plate 16 may be formed using the compression molding methods disclosed in U.S. Pat. Nos. 8,147,392 and 8,273,202, incorporated by reference above. More specifically, a first mold (not shown) may be used having cavities that define the contours of the outer surfaces of the rotor body 12. The first mold may also include a centrally located mold core that supports the rotor insert 96. A plurality of disk-shaped woven fiber sheets, pre-impregnated with an epoxy matrix, may be stacked vertically within the first mold and around the mold core, the stacked sheets progressively varying in diameter such that their outer edges define the contoured circumferential sidewall 20 of the rotor body 12 being formed.

The woven fiber sheets, which may be carbon fiber sheets, may include fibers woven in two transverse directions, and the sheets may include circumferentially spaced circular openings for defining the tubular cavities 24. As the woven fiber sheets are stacked, each successive sheet may be oriented such that the woven fibers forming the sheet are rotated (about the rotational axis of the rotor body 12 being formed) approximately 45 degrees relative to the woven fibers forming the immediately adjacent woven sheet positioned beneath it. After stacking the woven fiber sheets, the tubular cavities 24 may be further defined by inserting pre-formed tubular inserts into the angled apertures defined by the circular openings in the stacked woven sheets. Each tubular insert may be formed by a corresponding plurality of woven fiber sheets, layered radially about a longitudinal axis of the tubular insert. Heat and pressure may then be applied to the first mold containing the stacked woven fiber sheets to form the rotor body 12, the torque transfer members 50 and the torque transfer ring 60. Using similar compression molding techniques, a second mold may be used to form the pressure plate 16, and a third mold may be used to form the rotor lid 14, the pressure plate 16 and rotor lid 14 each being formed of a corresponding plurality of stacked woven fiber sheets.

In use, the rotor 10, including the rotor hub 94 threadedly engaged with the rotor insert 96 and the retaining nut 90, is mounted and coupled to a centrifuge spindle (not shown) of the centrifuge 13, such that a projecting portion of the spindle is received within the rotor hub 94. As shown in FIG. 6, a bottom face of the rotor hub 94 may include bores 110 for receiving alignment pins (not shown) for aligning the rotor 10 with the centrifuge spindle. With the rotor 10 seated on the spindle, a hub retainer 112 may then be received through a top end of the rotor hub 94, and be threadedly engaged with the rotor hub 94, as shown in FIG. 3. Attachment of the hub retainer 112 advantageously prevents the rotor hub 94, and thus the rotor body 12, from lifting vertically from the centrifuge spindle during operation. As shown in the illustrated embodiment, the hub retainer 112 may include a through-bore for receiving a central pin 114, the central pin 114 having an internal thread for receiving an externally threaded distal end of the centrifuge spindle. In alternative embodiments, the centrifuge rotor 10 may be fitted with any suitable coupling components for coupling the rotor insert 96 with any suitable centrifuge spindle.

A lid screw retainer 118 may be coupled to the hub retainer 112, for example by threaded engagement, and be configured to threadedly receive a lid screw 120 for securing the rotor lid 14 to the rotor body 12. As shown in FIG. 3, the lid screw 120 may be inserted axially through a central opening in the rotor lid 14, and may include the handle 18 at an outer end. The lid screw 120, via the handle 18, may be rotated by a user for threadedly engaging and disengaging the lid screw 120 with the lid screw retainer 118. When the lid screw 120 is fully threadedly engaged with the lid screw retainer 118, a base portion of the handle 18 exerts an axial compressive force on the rotor lid 14, thereby securing the lid 14 to the rotor body 12. The rotor lid 14, when coupled to the rotor body 12, blocks access to the sample containers held in the tubular cavities 24. Persons skilled in the art will appreciate that the retaining nut 90, the rotor hub 94, the rotor insert 96, the hub retainer 112, and the lid screw retainer 118 may be formed of any suitable material, such as metal, for example.

Furthermore, in the embodiment shown, the rotor lid 14 may include a sealing element 122, and the lid screw 120 may include a sealing element 124. The sealing elements 122, 124 may be o-rings, for example, and further facilitate coupling of the rotor lid 14 to the rotor body 12, and the lid screw 120 to the lid screw retainer 118, respectively. While the embodiment shown herein illustrates one coupling method for securing the rotor lid 14 to the rotor body 12, persons skilled in the art will appreciate that various alternative coupling methods may also be used.

After mounting the rotor 10 to the centrifuge spindle, the centrifuge spindle may then be actuated to drive the rotor 10 into high-speed, centrifugal rotation. During rotation of the rotor 10 of the illustrated embodiment, the rotating spindle exerts a torque on the rotor hub 94, which in turn exerts a torque on the rotor insert 96, which in turn exerts a torque on the central interior portion 51 and additionally the torque transfer ring 60. The torque transfer ring 60 then transfers torque radially outward through the torque transfer members 50. More specifically, the torque transfer members 50, in addition to central interior portion 51, transfer the torque radially outward to the tubular cavities 24 and the sample containers held therein. Accordingly, the torque applied to the tubular cavities 24 is transferred through not just the central interior portion 51, but also through the torque transfer ring 60 and the torque transfer members 50. Thus, provision of the torque transfer ring 60 and the torque transfer members 50 advantageously provides the rotor 10 with added structural rigidity for withstanding the high degrees of torque experienced during high-speed rotation. Additionally, the circumferentially spaced depressions 76, ribs 78, and upstanding tabs 80 formed on the pressure plate 16 provide additional structural rigidity to the tubular cavities 24, and thus to the rotor body 12 as a whole, during high-speed rotation.

FIGS. 10-17 show a centrifuge rotor 210 according to a second embodiment of the invention. The centrifuge rotor 210 is similar in construction to centrifuge rotor 10 except as otherwise described below. In that regard, similar reference numerals, including those not described in detail below, refer to similar features described above in connection with rotor 10 shown in FIGS. 1-8.

Figure 10:
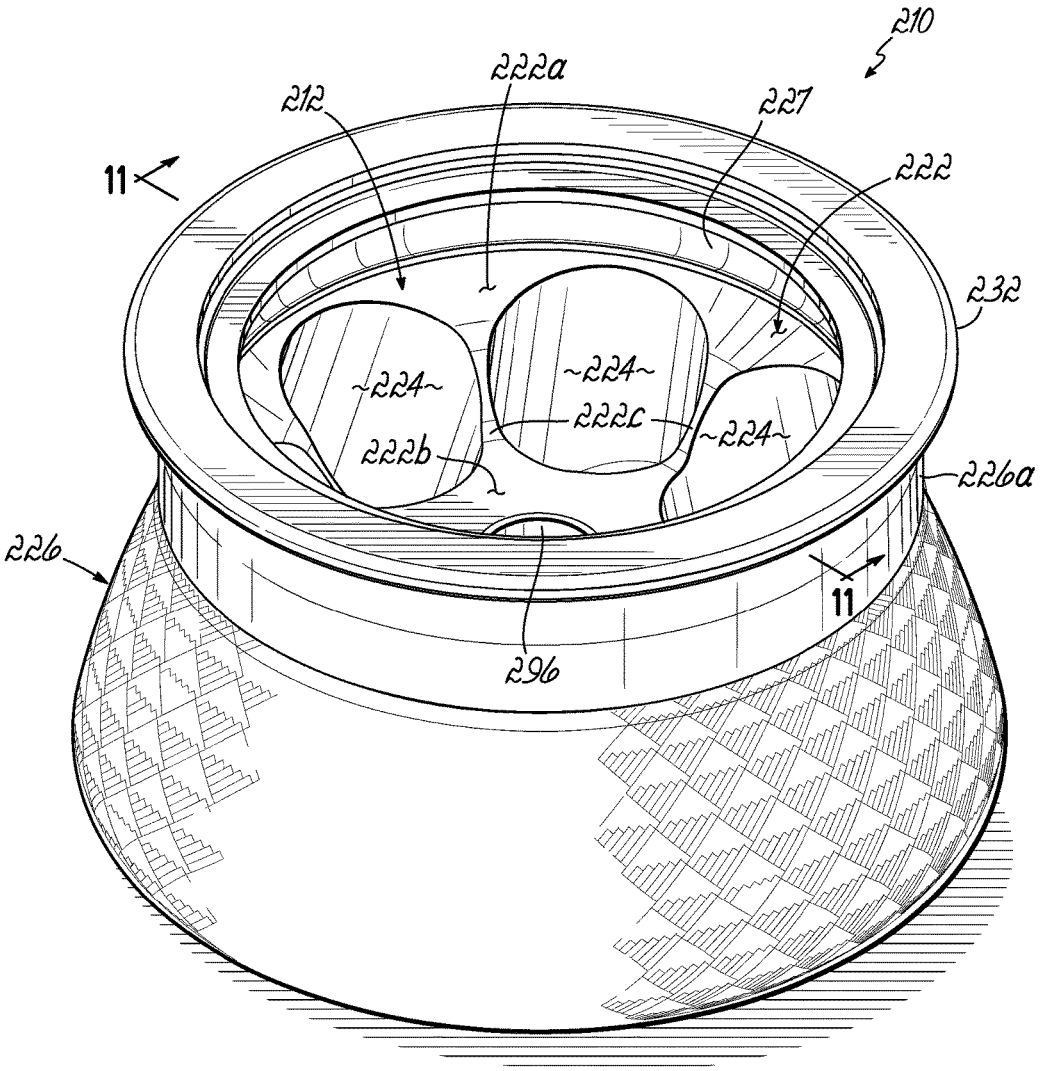
FIG. 10 is a perspective view of a centrifuge rotor in accordance with a second embodiment of the present invention, shown without a rotor lid or lid coupling components.
Figure 11:
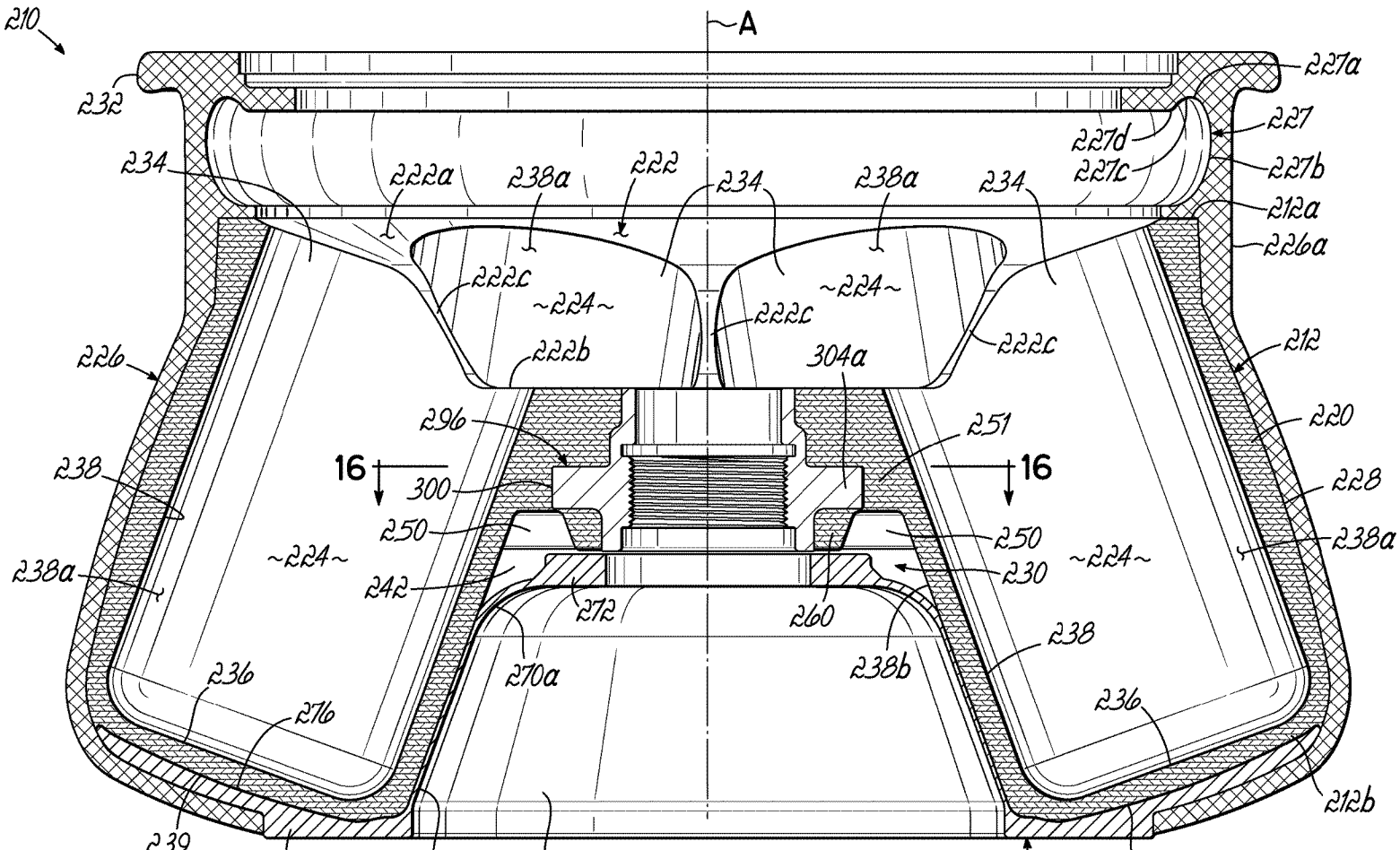
FIG. 11 is a cross-sectional view taken along line 11-11 of the centrifuge rotor of FIG. 10.

Referring to FIGS. 10 and 11, the centrifuge rotor 210 includes a rotor body 212, a rotor lid (not shown) operatively coupled to the rotor body 212 and supported above an upper end 212*a* thereof, and a pressure plate 216 operatively coupled to a lower end 212*b* of the rotor body 212. While the centrifuge rotor 210 is shown without a rotor lid, persons skilled in the art will appreciate that one may provided that is similar in construction to rotor lid 14 described above. Additionally, the rotor lid may be coupled to the rotor body 212 using components similar to those described above in connection with rotor lid 14.

The rotor 210 further includes an elongated reinforcement 226, which may be applied using similar methods described above in connection with reinforcement 26 such that it extends continuously around the rotor body 212 and radially outer portions of the pressure plate 216, thereby facilitating the coupling of the pressure plate 216 to the rotor body 212. The elongated reinforcement 226 may also extend above the upper end 212*a* of the rotor body 212 to form an upper reinforcement portion 226*a* that is configured to receive and support an outer circumferential edge of the rotor lid.

Referring to FIG. 11, the upper reinforcement portion 226*a* may be shaped to define an annular liquid containment groove 227 spaced axially above and radially outward of the top wall 222 of the rotor body 212. The liquid containment groove 227 operates in a manner similar to liquid containment groove 27 described above, by capturing leaked sample and retaining it within the centrifuge rotor 210 during centrifugation. The containment groove 227 includes an upper reentrant portion 227*a* where a profile of the groove 227 curves inwardly on itself toward the top wall 222. More specifically, the profile of the groove 227 curves from an arcuate back wall 227*b* in a direction axially upward and radially inward toward an upper apex region 227*c*, and then in a direction axially downward and radially inward toward a lower edge 227*d*, where the reentrant portion 227*a* then terminates. The upper reentrant portion 227*a* enhances the ability of the containment groove 227 to capture and retain leaked sample during centrifugation, thereby maintaining a safe and clean working environment.

Figure 17A:
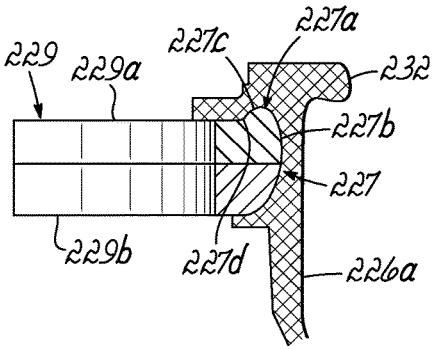
FIGS. 17A and 17B are cross-sectional schematic views showing portions of an annular grove tool for forming an annular liquid containment groove in an upper reinforcement portion of the centrifuge rotor of FIG. 10.
Figure 17B:
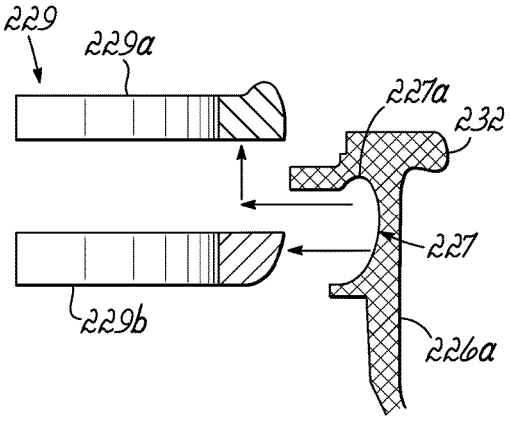

The liquid containment groove 227 may be formed using an annular groove tool 229 having multiple portions, as shown schematically in FIGS. 17A and 17B. The groove tool 229 may include an annular upper tool portion 229*a* shaped for forming the upper reentrant portion 227*a* of the containment groove 227, and an annular lower tool portion 229*b* shaped for forming the remaining lower portion of the containment groove 227. The upper and lower tool portions 229*a*, 229*b* may each be further divisible into circumferential sub-portions to facilitate removal of the groove tool 29 following formation of the upper reinforcement portion 226*a*, as described below.

Following formation of the rotor body 212, for example using the compression molding methods described above, the groove tool 229 may be positioned above the upper end 212*a* of the rotor body 212. The strand forming the elongated reinforcement 226, as described above in connection with reinforcement 26, may then be wound around the groove tool 229, in combination with winding around the rotor body 212 and the pressure plate 216, to form the upper reinforcement portion 226*a*. Following formation of the upper reinforcement portion 226*a*, the groove tool 229 may then be disassembled sequentially, for example by first removing the lower tool portion 229*b* and then removing the upper tool portion 229*a*, as shown by the directional arrows in FIGS. 17A and 17B. Removal of the tool 229 thus exposes the newly formed liquid containment groove 227, including the upper reentrant portion 227*a*. An additional tool or fixture (not shown) may be used during formation of the upper reinforcement portion 226*a* to form an annular lip 232 that extends radially outward from the upper reinforcement portion 226*a*. The annular lip 232 may gripped by a user and used as a handle for lifting and carrying the centrifuge rotor 210. A similar annular lip feature may be provided on the centrifuge rotor 10 described above as well.

Figure 12:
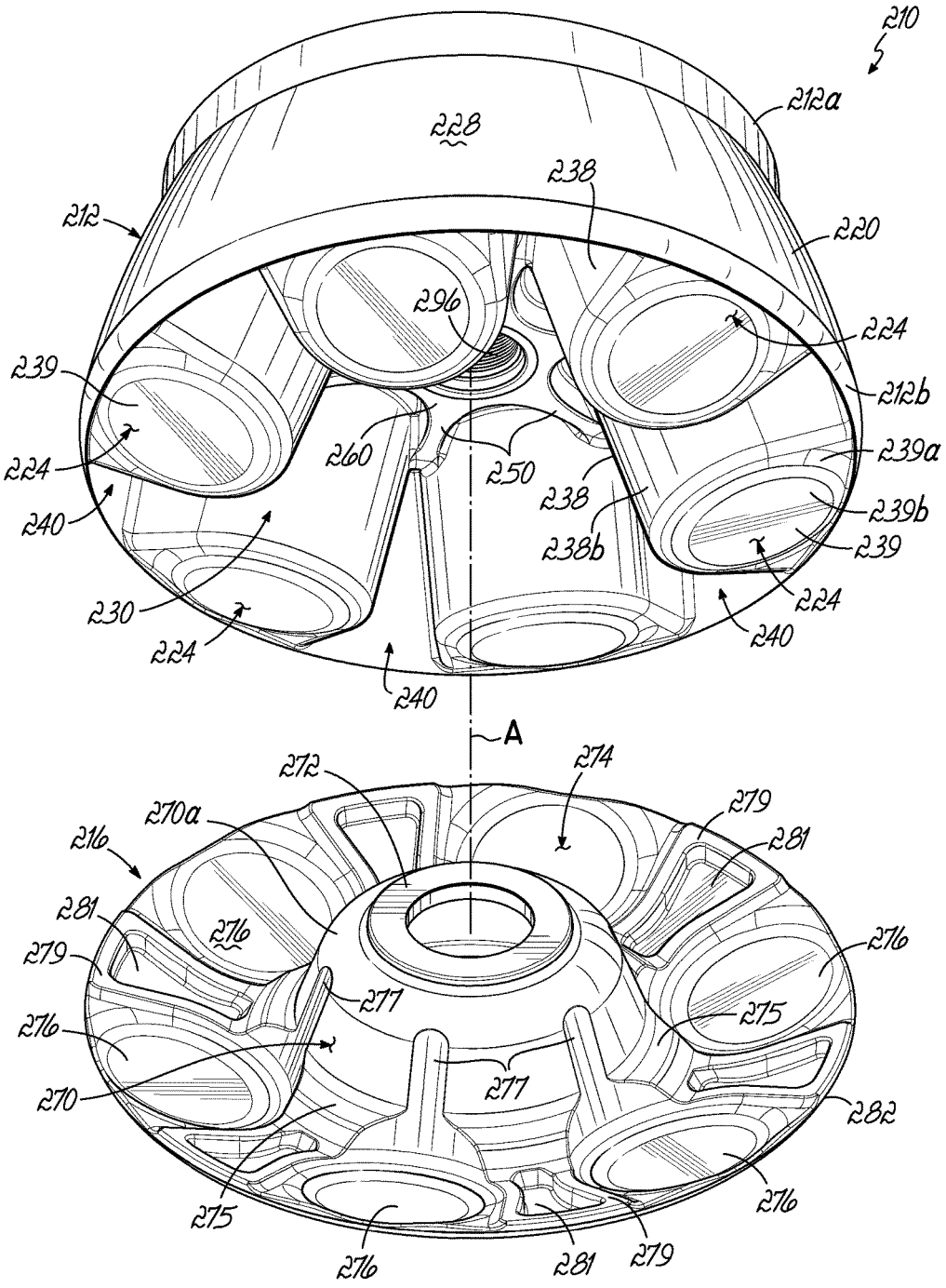
FIG. 12 is a partially disassembled, perspective view of the centrifuge rotor of FIG. 10, showing a rotor body and a pressure plate tilted open for better viewing and prior to application of an elongated reinforcement, and shown without a rotor hub and corresponding coupling components.

As shown in FIGS. 10-12, the rotor body 212 is formed symmetrically about a rotational axis A, about which sample containers are centrifugally rotated during operation. The rotor body 212 includes a circumferentially-extending sidewall 220 and a top wall 222 through which a plurality of circumferentially-spaced tubular cell hole cavities 224 extend for receiving a corresponding plurality of sample containers (not shown). In this embodiment, the top wall 222 may be scalloped so as to define an annular upper region 222*a* and a recessed lower region 222*b* that is centrally located about the rotational axis A. The upper region 222*a* and the lower region 222*b* are connected by a plurality of sloped connecting portions 222*c* spanning therebetween and being circumferentially-spaced about the rotational axis A between the tubular cavities 224.

The scalloped configuration of the top wall 222, as described above, provides several advantages. For example, the top wall 222 may be formed using less material, thereby minimizing weight of the rotor body 212 and a minimizing a rotational moment of inertia of the centrifuge rotor 210 about the rotational axis A. Additionally, this scalloped configuration serves to expose upper portions of the sample containers facing inwardly toward the rotational axis A near the recessed lower region 222*b*. These exposed upper portions, which may be portions of the sample container closures, may be easily gripped by an operator for removal of the sample containers from their respective tubular cavities 224. Furthermore, the scalloped configuration of top wall 222 serves to minimize a wall thickness of each sloped connecting portion 222*c* in a circumferential direction, thereby permitting the upper portions of the sample containers to be positioned closer to the rotation axis A, and thus provide a more compact design.

In this embodiment, the rotor body 212 includes six tubular cell hole cavities 224, each of which may be sized to receive a sample container having an internal volume of approximately 2,000 ml, for example. As described above in connection with centrifuge rotor 10, alternative embodiments of centrifuge rotor 210 may include any suitable number of tubular cavities 224, wherein each cavity 224 defines any suitable cavity volume. In such alternative embodiments, additional features of the rotor 210 may be modified in quantity, size, and/or position as appropriate.

Each of the tubular cell hole cavities 224 extends from the top wall 222 into an interior 230 of the rotor body 212, in a direction generally toward the lower end 212*b* of the rotor body 212 and angularly relative to the rotational axis A. Each tubular cavity 224 includes an open end 234 at the top wall 222 and an oppositely disposed closed end 236 oriented toward the lower end 212*b*. Each tubular cavity 224 is defined by a sidewall 238 and a bottom wall 239, and is suitably sized and shaped to receive a sample container therein (not shown) for centrifugation about rotational axis A. Each cavity sidewall 238 includes an inner face 238*a* that receives and supports the respective sample container, and an outer face 238*b* that faces generally toward the interior 230 of the rotor body 212.

Figure 13:
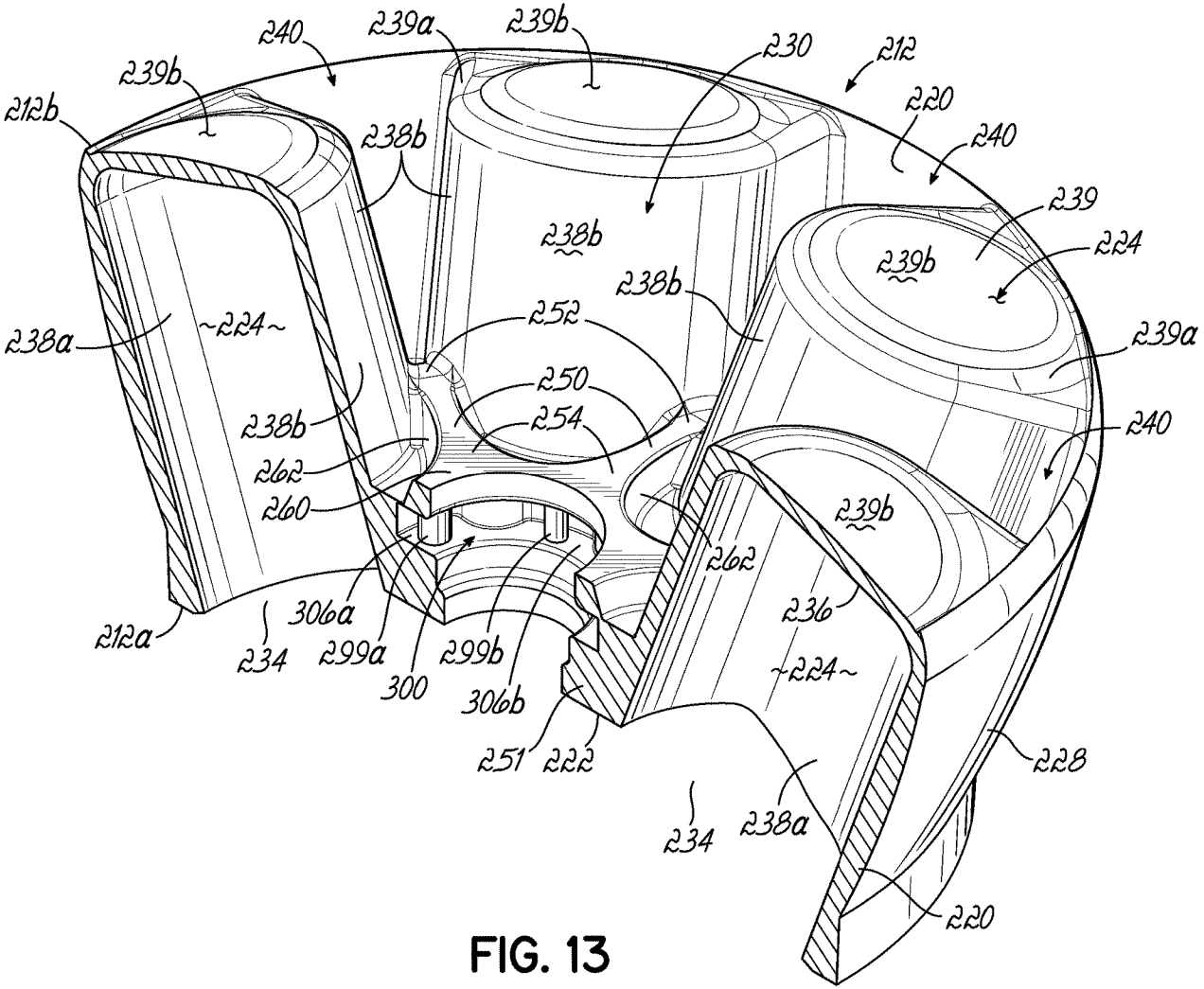
FIG. 13 is a cross-sectional view taken along line 11-11 of the rotor body of the centrifuge rotor of FIG. 10, showing the rotor body inverted and without a rotor insert.

As best shown in FIGS. 12 and 13, the tubular cavities 224 are circumferentially spaced radially inward of the circumferential sidewall 220, such that the sidewall 220 and the outer faces 238*b* of the cavities 224 define a plurality of circumferentially-spaced pockets 240, each pocket 240 being defined between an adjacent pair of respective tubular cavities 224. As described in greater detail below, the outer faces 238*b*, in combination with the circumferential sidewall 220 and the pressure plate 216, collectively define a centrally located, hollow chamber 242 including the pockets 240.

Referring to FIGS. 11-13, a plurality of circumferentially-spaced, elongated torque transfer members 250 are supported by the rotor body 212, and may be operatively coupled to a central interior portion 251 of the rotor body 212, according to one embodiment. As described above in connection with torque transfer members 50, the torque transfer members 250 operate to transfer torque from a centrifuge spindle (not shown) of the centrifuge 13 to the tubular cavities 224 during centrifugation. Each torque transfer member 250 extends radially between an outer first end 252 and an inner second end 254 oriented toward the rotational axis A. In the embodiment shown, the first end 252 of each torque transfer member 250 extends between and tangentially to an adjacent pair of respective tubular cavities 224, toward a respective pocket 240.

As shown, the rotor 210 may include six torque transfer members 250, such that one member 250 extends between each adjacent pair of tubular cavities 224. As described above, the rotor 210 may be formed with any suitable number of tubular cavities 224. Accordingly, the rotor 210 may be formed with any suitable number of torque transfer members 250, to maintain any desired ratio of torque transfer members 250 to tubular cavities 224.

The rotor 210 may further include a torque transfer ring 260 supported by the rotor body 212, and which may be operatively coupled to the central interior portion 251 of the rotor body 212, according to one embodiment. As shown, the torque transfer ring 260 extends from a bottom surface of the top wall 222 into the interior 230, and thus into the hollow chamber 242. As shown, the torque transfer ring 260 is centrally located about the rotational axis A such that the second end 254 of each torque transfer member 250 extends radially toward and operatively couples to the torque transfer ring 260. In one embodiment, the torque transfer members 250 and torque transfer ring 260 may be formed integrally as one piece with the rotor body 212, including the top wall 222, the central interior portion 251, and the sidewalls 238 of the tubular cavities 224. In an alternative embodiment, either or both of the torque transfer members 250 and the torque transfer ring 260 may be releasably coupled to the rotor body 212.

As shown in FIG. 13, the torque transfer members 250 may be formed integrally as one piece with the torque transfer ring 260. In an alternative embodiment, the torque transfer members 250 may be releasably coupled to the torque transfer ring 260. In another alternative embodiment, the rotor 210 may be formed without the torque transfer ring 260, such that the torque transfer members 250 extend radially (independently) toward the rotational axis A. In yet another embodiment, the torque transfer members 250 may be coupled to one or more intermediate structures (not shown) positioned radially between the torque transfer members 250 and the torque transfer ring 260, when provided. Alternatively, when the torque transfer ring 260 is not provided, the torque transfer members 250 may be coupled, either individually or in sets of two or more, to one or more intermediate structures (not shown) positioned radially between the torque transfer members 250 and the rotational axis A.

Figure 14:
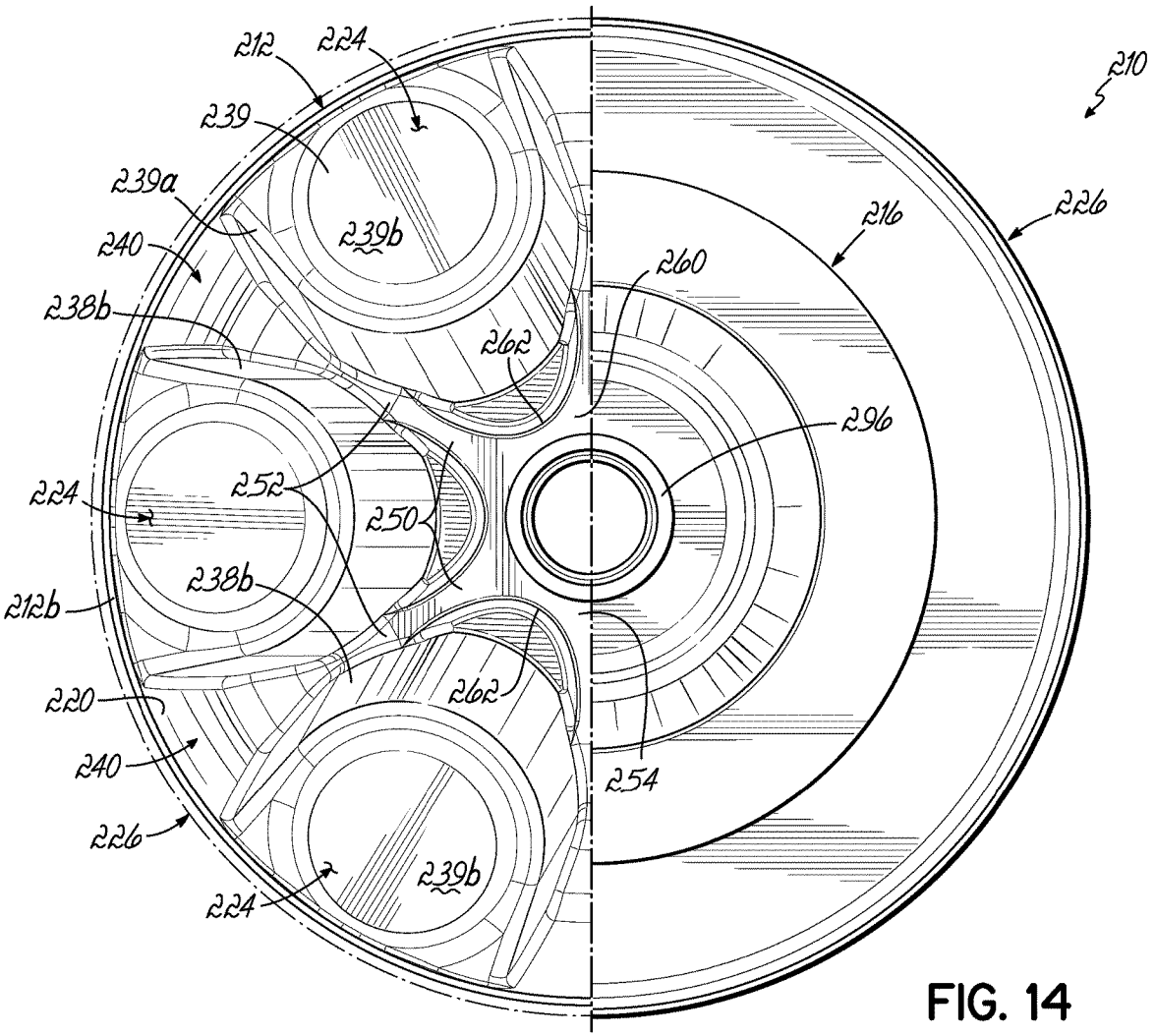
FIG. 14 is a partially broken away plan view of the bottom of the centrifuge rotor of FIG. 10.

As best shown in FIGS. 13 and 14, each of the torque transfer members 250 may be formed symmetrically along its radial length. Furthermore, each torque transfer member 250 may be formed with a shape and size that is common to each of the other torque transfer members 250. Additionally, each pair of adjacent torque transfer members 250 defines an arcuate sidewall 262 spanning therebetween along a substantially parabolic-shaped path, for example. As shown, each arcuate sidewall 262 may be formed with an arcuate length and a curvature that is common to each of the other arcuate sidewalls 262.

The torque transfer members 250 extend generally axially from a bottom surface of the top wall 222 into the interior 230, and thus into the hollow chamber 242, such that each arcuate sidewall 262 defines an axial thickness of its respective torque transfer members 250. As best shown in FIG. 13, each of the torque transfer members 50 may be formed with an axial thickness that is substantially constant along a radial length of the torque transfer member 250 between its second end 254 and its first end 252. Additionally, each torque transfer members 250 may be substantially planar along its radial length.

The torque transfer members 250 and torque transfer ring 260 may be formed of any suitable material or combination of materials. For example, the torque transfer members 250 and/or the torque transfer ring 260 may be formed of a carbon fiber composite having an optimized fiber orientation. In an alternative embodiment, the torque transfer members 250 and/or the torque transfer ring 260 may be formed of a metal.

Referring to FIGS. 11 and 12, the pressure plate 216 of the centrifuge rotor 210 includes a central, generally conical upstanding wall portion 270 having a rounded upper portion 270*a*, an annular top wall portion 272 protruding axially from the rounded upper portion 270*a*, an annular bottom wall portion 274 extending generally radially outward from the conical wall portion 270, and an annular support ring 275 extending between and connecting the conical wall portion 270 and the bottom wall portion 274.

Figure 15:
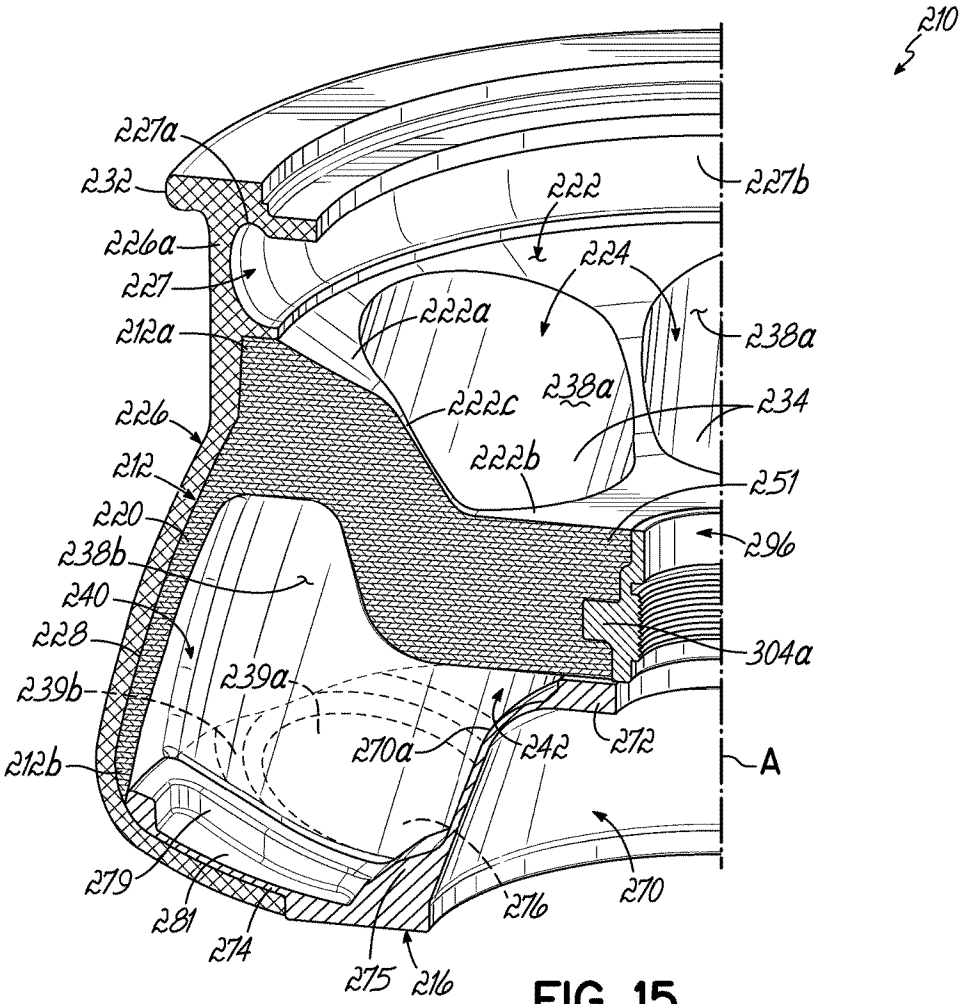
FIG. 15 is a perspective, partial cross-sectional view taken axially through a pocket of the rotor body of the centrifuge rotor of FIG. 10, showing additional detail of a raised section of a pressure plate being received within the pocket of the rotor body.

As shown in FIG. 15, the pressure plate 216 may be operatively coupled to the lower end 212*b* of the rotor body 212, such that the conical wall portion 270 is received within the interior 230 of the rotor body 212 and engages a radially inward-facing side portion of each of the outer faces 238*b* of the tubular cavities 224. The pressure plate 216 may be seated against the rotor body 212 such that the top wall portion 272 confronts the torque transfer ring 260 supported by the top wall 222. The coupling of the pressure plate 216 to the rotor body 212 fully defines the hollow chamber 242, including the pockets 240. In particular, the hollow chamber 242 is bordered by the circumferential sidewall 220, the top wall 222, and the outer faces 238*b* of the rotor body 212, and by the conical wall portion 270, the top wall portion 272, and the bottom wall portion 274 of the pressure plate 216. Accordingly, in the illustrated embodiment of rotor 210, a substantial portion of each of the outer faces 238*b* of the tubular cavities 224 is surrounded by hollow space including the hollow chamber 242 and a respective pair of adjacent pockets 240.

As best shown in FIG. 12, the annular bottom wall portion 274 of the pressure plate 216 includes a plurality of circumferentially-spaced depressions 276. The conical wall portion 270 includes a corresponding plurality of circumferentially-spaced scallops 277 that extend downwardly through the annular support ring 275 toward the bottom wall portion 274, and open to the depressions 276. In particular, the pressure plate 216 preferably includes one depression 276 and one scallop 277 for each tubular cavity 224 (i.e., six depressions 276 and six scallops 277 for the embodiment shown in FIGS. 10-16).

As shown in FIG. 15, the depressions 276 of pressure plate 216 are configured to receive and engage, in abutting relationship, the plurality of bottom walls 239 of the tubular cavities 224, when the pressure plate 216 is coupled to the rotor body 212. As shown best in FIGS. 12 and 13, each bottom wall 239 may include a shoulder portion 239*a* having a substantially U-shape defined by the curvature of the outer face 238*b* of the tubular cavity sidewall 238. In that regard, the outer face 238*b* of each tubular cavity 224 may form a substantially right angle (i.e., approximately ninety degrees) with the circumferential sidewall 220 of the rotor body 212. Each bottom wall 239 may further include a central boss portion 239*b*, which may be substantially circular, extending outwardly from the shoulder portion 239*a*, such that the shoulder portion 239*a* extends around the boss portion 239*b*. The depressions 276 are suitably sized and shaped such that each depression 276 contacts a substantial portion of a respective bottom wall 239 of a respective tubular cavity 24, including the shoulder portion 239*a* and the central boss portion 239*b*. In that regard, each depression 276 may be substantially U-shaped and may include a circular recess, so as to substantially correspond to the shape of the bottom wall 239.

Similarly, the scallops 277 are configured to receive and engage, in abutting relationship, the outer faces 238*b* of the tubular cavities 224. In particular, the scallops 277 are suitably sized and shaped such that each scallop 277 substantially conforms to the curvature of a lower portion of a respective outer face 38*b*.

The pressure plate 216 may be mated with the rotor body 212 such that each depression 276 and corresponding scallop 277 jointly engage a respective tubular cavity 224. In this manner, the depressions 276 provide structural support to the tubular cavities 224, thereby providing rigidity during high-speed rotation of the rotor 10, while the scallops 277 assist in maintaining circumferential alignment of the pressure plate 216 relative to the rotor body 212. In an alternative embodiment, the pressure plate 216 may include a quantity of depressions that is less than the quantity of tubular cavities 224, where each depression is suitably sized and shaped to receive and engage two or more tubular cavities 224.

The pressure plate 216 may further include a plurality of circumferentially-spaced raised sections 279 disposed on the annular bottom wall portion 274. As best shown in FIG. 12, a raised section 279 may be provided between each pair of adjacent depressions 276 and extend upwardly from the outer edges thereof and extend radially toward the support ring 275 to form a connection therewith. Each raised section 279 may include a central recess 281, which may be substantially trapezoidal in shape and include a narrowed middle region having a bottleneck-like shape. Each raised section 279 is suitably sized and shaped to be received in a pocket 240 formed between a respective pair of adjacent tubular cavities 224 when the pressure plate 216 is coupled with the rotor body 212, as shown in FIG. 15. In that regard, the raised section 279 engages corresponding structure defined by the shoulder portion 239*a* and the central boss portion 239*b* of the bottom wall 239 of the respective tubular cavity 224. Accordingly, the raised sections 279 properly align the pressure plate 216 with the rotor body 212 during assembly, and provide additional structural support to the rotor body 212, including the tubular cavities 224, during high-speed rotation of the rotor 210. Moreover, the combination of the annular support ring 275, the raised sections 279, and the central recesses 281 of the pressure plate 216 advantageously provides the pressure plate 216 with increased structural rigidity while simultaneously minimizing weight.

Coupling of the pressure plate 216 to the rotor body 212 may be achieved with the assistance of mechanical coupling components substantially similar to those described above in connection with centrifuge rotor 10. Additionally, coupling between the pressure plate 216 and rotor body 212 may be further enhanced by application of the elongated reinforcement 226, which may be applied to the rotor body 212 and pressure plate 216 in a manner substantially similar to that described above in connection with elongated reinforcement 26 of rotor 10.

Figure 16:
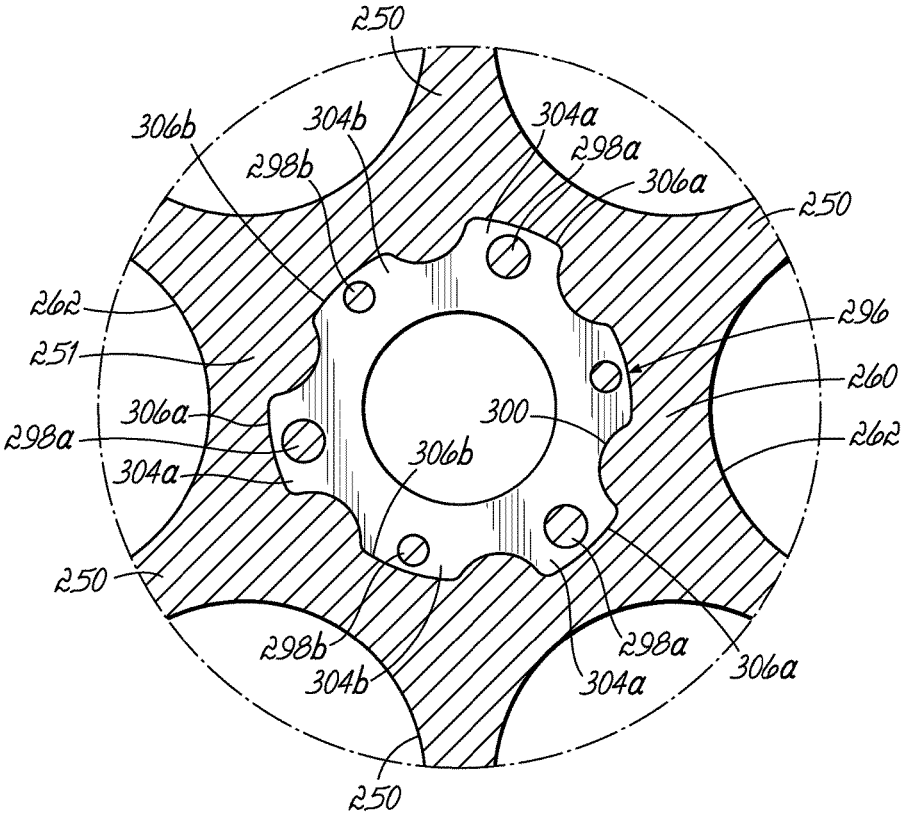
FIG. 16 is a partial cross-sectional view taken along line 16-16 of the centrifuge rotor of FIG. 11, showing additional detail of a rotor insert.

The rotor body 212 further includes a rotor insert 296 provided within an internal pocket 300 of a central interior portion 251, as best shown in FIGS. 11, 13, and 16. The rotor insert 296 operates in a manner similar to rotor insert 96 described above, including being configured to receive and threadedly engage a rotor hub (not shown).

The rotor insert 296 is located about the rotational axis A such that it extends through an opening 302 formed in the top wall 222, the central interior portion 251, and the torque transfer ring 260. The rotor insert 296 includes a plurality of alternating, radially extending long arms 304*a* and short arms 304*b* that are received within a corresponding plurality of alternating, radially extending long channels 306*a* and short channels 306*b* of the internal pocket 300. In one embodiment, the rotor 210 may be formed such that the number of arms 304*a*, 304*b* and respective channels 306*a*, 306*b* is equal to the number of tubular cavities 224. More specifically, the number of long arms 304*a* may be equal to one-half of the number of tubular cavities 224. For example, in the embodiment shown, the rotor 210 includes six tubular cavities 224 and a rotor insert 296 having three long arms 304*a* and three short arms 304*b*, and an internal pocket 300 having three long channels 306*a* and three short channels 306*b* for receiving the respective arms 304*a*, 304*b*. Persons skilled in the art will appreciate that alternative embodiments of the rotor 210 may be formed with any desired ratio of tubular cavities 224 to rotor insert arms 304*a*, 304*b* and corresponding pocket channels 306*a*, 306*b*. Additionally, in alternative embodiments, the rotor insert arms and corresponding pocket channels may be formed with any suitable shapes and sizes.

The rotor insert 296 may be formed of any suitable material, such as a metal. Additionally, the radially extending arms 304*a*, 304*b* may each include a respective aperture 298*a*, 298*b* extending axially therethrough. for weight reduction purposes, for example. Additionally, the rotor insert 296 may be molded into the rotor body 212 during body formation, as disclosed by U.S. Pat. Nos. 8,147,392 and 8,273,202, incorporated by reference above. During molding process, liquid adhesive may flow into and substantially fill each of the apertures 298*a*, 298*b* extending through the rotor insert 296. The adhesive may then cure to form solid columns 299*a* and 299*b* extending through the respective apertures 298*a*, 298*b*. The columns 299*a*, 299*b* may operate to securely retain the rotor insert 296 within the central interior portion 251, and to provide the rotor body 212 with additional structural rigidity.

The rotor body 212 and the pressure plate 216 may be formed using the compression molding methods described above in connection with centrifuge rotor 10 and the U.S. patents incorporated herein. Additionally, the assembled centrifuge rotor 210 may be mounted to a centrifuge spindle (not shown) of the centrifuge 13 in a manner similar to, and with coupling components similar to, those described above in connection with centrifuge rotor 10. In other embodiments, the rotor 210 may be fitted with any suitable coupling components for coupling the rotor insert 296 with any suitable centrifuge spindle.

After mounting the rotor 210 to the centrifuge spindle, the centrifuge spindle may then be actuated to drive the rotor 210 into high-speed, centrifugal rotation. During rotation of the rotor 210, the components thereof may operate in a manner similar to those described above in connection with rotor 10. In particular, a torque is transferred from the rotating rotor spindle to the rotor insert 96, which in turn exerts a torque on the central interior portion 251 and additionally the torque transfer ring 260. The torque transfer ring 260 then transfers torque radially outward through the torque transfer members 250. More specifically, the torque transfer members 250, in addition to central interior portion 251, transfer the torque radially outward to the tubular cavities 224 and the sample containers held therein. Accordingly, the torque applied to the tubular cavities 224 is transferred through not just the central interior portion 251, but also through the torque transfer ring 260 and the torque transfer members 250. Thus, provision of the torque transfer ring 260 and the torque transfer members 250 advantageously provides the rotor 210 with added structural rigidity for withstanding the high degrees of torque experienced during high-speed rotation. Additionally, the annular support ring 275, circumferentially spaced depressions 276, and raised sections 279 may provide additional structural rigidity to the tubular cavities 224, and thus to the rotor body 212 as a whole, during high-speed rotation.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A fixed angle centrifuge rotor, comprising:

a rotor body having a plurality of tubular cavities spaced circumferentially about a rotational axis of the rotor, each of the tubular cavities having an open end and a closed end, and each of the tubular cavities being configured to receive a sample container therein; and an annular containment groove disposed above and circumferentially surrounding the plurality of tubular cavities, the annular containment groove having an upper reentrant portion in which a profile of the groove curves from an arcuate back wall in a direction axially upward and then radially inward toward an upper apex region and then curves in a direction axially downward and radially inward toward an edge of the rotor body, wherein the annular containment groove, in combination with the upper reentrant portion, is configured to capture and retain stray material within the rotor during rotation of the rotor.

2. The rotor of claim 1, further comprising:

a reinforcement layer surrounding at least a portion of the rotor body, the annular containment groove being provided in the reinforcement layer.

3. The rotor of claim 1, further comprising:

a plurality of elongated torque transfer members provided on the rotor body, with each of the torque transfer members having a first end located between a respective pair of adjacent tubular cavities and extending radially inward in a direction toward a rotational axis of the rotor.

4. The rotor of claim 3, further comprising:

a torque transfer ring provided on the rotor body about the rotational axis of the rotor; and a second end of each of the torque transfer members being coupled to the torque transfer ring.

5. The rotor of claim 1, further comprising:

a plurality of pockets provided in the rotor body, each being located between a respective pair of adjacent tubular cavities;

a pressure plate operatively coupled to the rotor body so that the pressure plate, in combination with the plurality of tubular cavities and a circumferential sidewall of the rotor body, define a hollow chamber within the rotor; and a plurality of circumferentially spaced upstanding tabs supported by the pressure plate, each of the plurality of tabs being received in a respective one of the plurality of pockets.

6. The rotor of claim 5, wherein the pressure plate includes a circumferential outer edge, and further wherein each of the plurality of circumferentially spaced upstanding tabs is located adjacent the outer edge.

7. The rotor of claim 6, wherein the pressure plate comprises a generally conical upstanding wall portion and a bottom wall portion extending outwardly from the generally conical upstanding wall portion, and further wherein the pressure plate has a plurality of circumferentially spaced ribs provided on the generally conical wall portion that are each configured to extend between a respective pair of adjacent tubular cavities.

8. In combination, a centrifuge and the rotor of claim 1.

* * * * *